US006726061B2

(12) United States Patent
Good

(10) Patent No.: US 6,726,061 B2
(45) Date of Patent: Apr. 27, 2004

(54) SYSTEM FOR DISPENSING A VISCOUS COMESTIBLE PRODUCT

(76) Inventor: Richard L. Good, 4361 New Holland Rd., Mohnton, PA (US) 19540

( * ) Notice: Subject to any disclaimer, the term of this patent is extended or adjusted under 35 U.S.C. 154(b) by 111 days.

(21) Appl. No.: 10/083,804

(22) Filed: Feb. 27, 2002

(65) Prior Publication Data

US 2002/0121527 A1 Sep. 5, 2002

Related U.S. Application Data

(60) Provisional application No. 60/272,489, filed on Mar. 1, 2001.

(51) Int. Cl.[7] ..... B65D 35/56

(52) U.S. Cl. ..... 222/95; 222/105; 222/129; 222/146.5; 222/185.1; 222/325

(58) Field of Search ..... 222/94, 95, 105, 222/107, 129, 135, 146.1, 146.2, 146.5, 183, 185.1, 325

(56) References Cited

U.S. PATENT DOCUMENTS

| | | | | |
|---|---|---|---|---|
| D141,362 | S | | 5/1945 | Elkins |
| 3,212,681 | A | | 10/1965 | Weikert |
| 3,297,206 | A | | 1/1967 | Scholle |
| 3,332,585 | A | | 7/1967 | Cox |
| D215,045 | S | | 8/1969 | Benjamin |
| 3,520,451 | A | | 7/1970 | Ashizawa |
| D220,303 | S | | 3/1971 | Gran |
| 3,580,427 | A | | 5/1971 | Clarke |
| D246,310 | S | | 11/1977 | Syverson, deceased et al. |
| 4,094,446 | A | | 6/1978 | Brutsman |
| D251,564 | S | | 4/1979 | MacKrell |
| 4,228,925 | A | | 10/1980 | Mendelovich |
| D274,779 | S | | 7/1984 | LaLumiere |
| 4,463,876 | A | * | 8/1984 | Swallert ..... 222/94 |
| 4,465,487 | A | | 8/1984 | Nakamura et al. |
| 4,474,214 | A | | 10/1984 | Iannelli |
| 4,513,885 | A | | 4/1985 | Hogan |
| 4,516,977 | A | | 5/1985 | Herbert |
| 4,518,106 | A | | 5/1985 | LaFleur |
| 4,544,085 | A | | 10/1985 | Frazer |
| D287,690 | S | | 1/1987 | Steinkamp |
| 4,651,898 | A | | 3/1987 | Bell |
| 4,690,307 | A | | 9/1987 | Hogan |
| 4,717,047 | A | | 1/1988 | van Overbruggen et al. |
| 4,796,788 | A | | 1/1989 | Bond |
| 4,993,593 | A | * | 2/1991 | Fabiano et al. ..... 222/1 |
| 5,040,700 | A | | 8/1991 | Compton |
| 5,069,364 | A | | 12/1991 | McGill |
| 5,102,015 | A | | 4/1992 | Barnard et al. |
| 5,114,045 | A | | 5/1992 | Herpe |

(List continued on next page.)

FOREIGN PATENT DOCUMENTS

| | | |
|---|---|---|
| CA | 1179992 | 12/1984 |
| DE | 2933375 | 3/1981 |
| DE | 3505957 | 8/1986 |
| EP | 0117509 | 9/1984 |
| FR | 2561229 | 9/1985 |

*Primary Examiner*—Gene Mancene
*Assistant Examiner*—Patrick Buechlner
(74) *Attorney, Agent, or Firm*—Volpe and Koenig, P.C.

(57) ABSTRACT

A system for dispensing a viscous comestible product. The system receives a bag containing the viscous comestible product. The bag has a bag body and a bag nozzle. The system includes a dispenser having a dispenser body defining a chamber for receiving the bag. The chamber has a surface with an opening defined therein adapted to receive the bag nozzle. A first protrusion is disposed proximate to a perimeter of the opening. The first protrusion extends from the surface generally inwardly into the chamber and is adapted to abut and flex the bag body into a configuration facilitating a flow of the viscous comestible product therefrom.

33 Claims, 14 Drawing Sheets

U.S. PATENT DOCUMENTS

| | | | | | |
|---|---|---|---|---|---|
| D328,220 | S | | 7/1992 | Barnard et al. | |
| 5,142,610 | A | | 8/1992 | Augustine et al. | |
| 5,169,292 | A | | 12/1992 | Loubier et al. | |
| 5,285,815 | A | | 2/1994 | Henry et al. | |
| 5,292,031 | A | | 3/1994 | Dagan | |
| 5,342,345 | A | | 8/1994 | Spencer | |
| 5,349,825 | A | | 9/1994 | Duke et al. | |
| 5,353,963 | A | | 10/1994 | Gorski et al. | |
| 5,411,178 | A | | 5/1995 | Roders et al. | |
| 5,449,027 | A | | 9/1995 | Mueller | |
| D365,962 | S | | 1/1996 | Amundsen et al. | |
| 5,553,740 | A | | 9/1996 | King et al. | |
| 5,673,817 | A | * | 10/1997 | Mullen et al. | 222/94 |
| 5,803,317 | A | | 9/1998 | Wheeler | |
| 5,803,377 | A | | 9/1998 | Farrell | |
| 5,875,930 | A | | 3/1999 | Nakajima et al. | |
| 6,016,935 | A | | 1/2000 | Huegerich et al. | |
| 6,024,252 | A | * | 2/2000 | Clyde | 222/105 |
| 6,056,157 | A | * | 5/2000 | Gehl et al. | 222/94 |
| 6,062,425 | A | * | 5/2000 | Brown et al. | 222/1 |
| 6,089,406 | A | * | 7/2000 | Feldner | 222/103 |
| 6,244,474 | B1 | | 6/2001 | Loeffler | |

* cited by examiner

FIG. 19
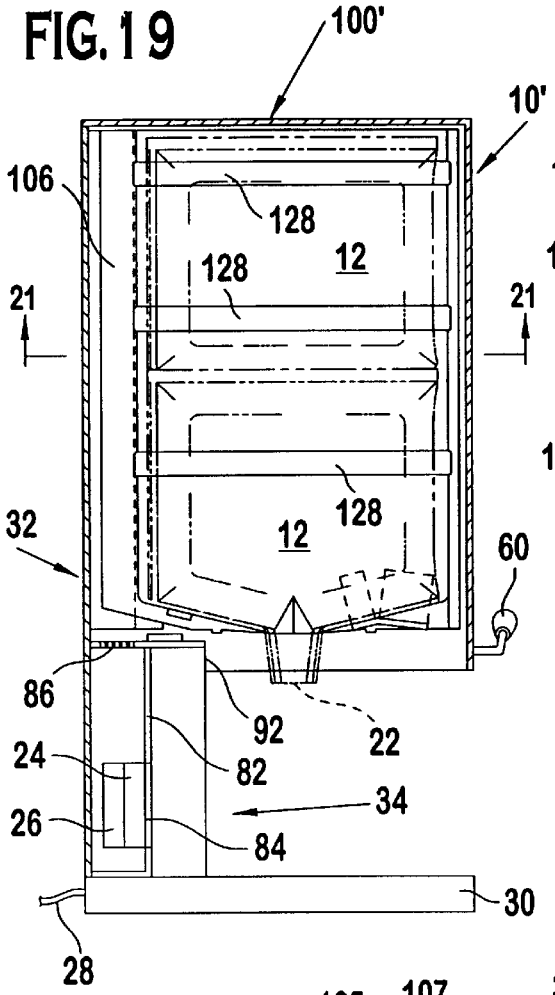
FIG. 20
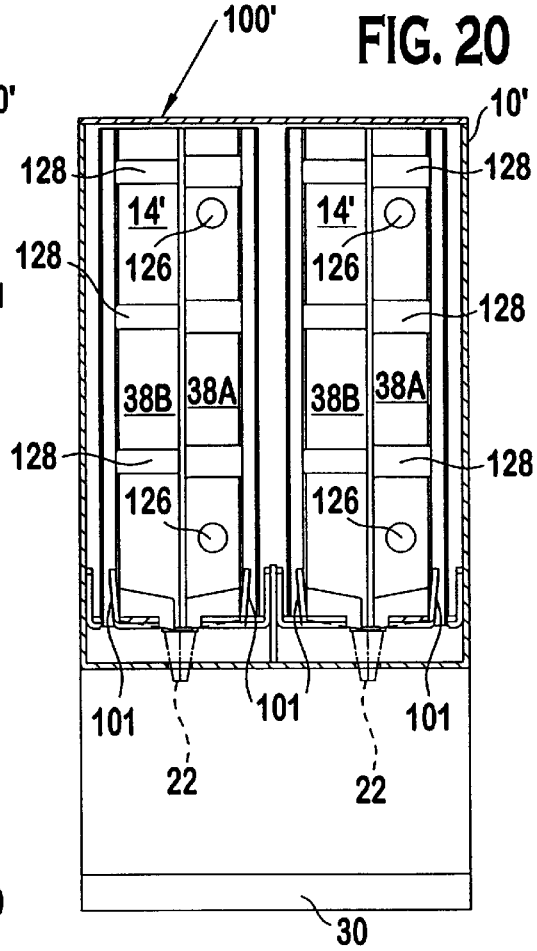
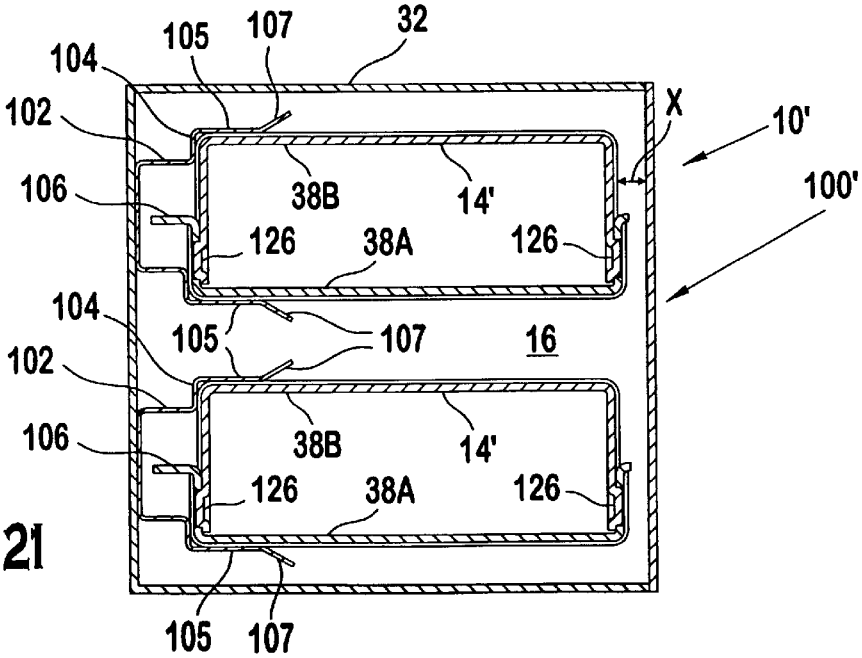
FIG. 21

SYSTEM FOR DISPENSING A VISCOUS COMESTIBLE PRODUCT

CROSS REFERENCE TO RELATED APPLICATION

This application claims the benefit of U.S. Provisional Patent Application No. 60/272,489, filed Mar. 1, 2001, entitled "Comestible Product Dispenser" which is hereby incorporated by reference herein in its entirety as if fully set forth.

BACKGROUND

The present invention relates generally to dispensers and, more specifically, to comestible product dispensers.

In the food service industry there are a wide variety of devices that are used to dispense viscous comestible products. Such dispensers are commonly found in restaurants, convenience stores and other commercial eating establishments. Many viscous comestible products, such as cheese sauces and ice cream toppings, do not flow well at room temperatures and must be maintained in a heated condition during use.

A typical comestible product dispenser uses a pump and a connecting nozzle tube to transfer the comestible product from a heated product container to a dispenser nozzle. However, the use of such a dispensing apparatus has many disadvantages. Since the pump, receptacle and nozzle are in direct contact with the comestible product, each component requires frequent dismantling and cleaning to avoid contamination and bacterial growth. This problem is further exacerbated when dairy products are used with the dispenser. Many locales have health laws mandating daily cleaning of dispensers used with dairy products.

Many heated viscous comestible products used in dispensers tend to congeal as they cool. To properly clean a dispenser having congealed comestible product thereon, it is necessary to soak various dispenser components to loosen encrusted material. Additionally, the reuse of tubes and various components makes it difficult to rid the dispenser of all encrusted particles which can result in pathogen growth within the dispenser.

One method of reducing the number of components contacting the comestible product contained in the dispenser is to use individual comestible product holding bags that are inserted into the dispenser for use. A typical comestible product holding bag includes a fitment with an attachable tube that provides a passage for transporting comestible product from the bag and out of the dispenser. However, this adds additional cost to the bag and may require special dispensing equipment, such as a dispenser with a peristaltic pump which engages the tube or a dispenser with a connectable flow-through valve which requires frequent cleaning. Additionally, for bags which do not include a fitment, the deformable nature of such comestible product holding bags can result in portions of the bag obstructing the flow of product through the nozzle. This obstruction of the flow from the bag reduces the evacuation of bag contents and reduces dispenser efficiency.

Applicants have recognized that it would be desirable to provide a comestible product dispenser that is designed for simplified cleaning and that reduces nozzle obstructions caused by the crimping, or folding over, of bags containing comestible product.

SUMMARY

Briefly stated, the present invention is directed to a system for dispensing a viscous comestible product. The system is capable of receiving a bag containing the viscous comestible product. The bag has a bag body and a bag nozzle. The system includes a dispenser having a dispenser body defining a chamber for receiving the bag. The chamber has a surface with an opening defined therein adapted to receive the bag nozzle. The opening has a perimeter. A first protrusion is disposed proximate to the perimeter of the opening. The first protrusion extends from the surface generally inwardly into the chamber and is adapted to abut and flex the bag body into a configuration facilitating a flow of the viscous comestible product therefrom.

In another aspect, the present invention is directed to a system for dispensing a viscous comestible product. The system is adapted to receive a bag containing the viscous comestible product. The bag has a bag nozzle. The system includes a dispenser having a dispenser body defining a chamber and a passageway for fluid communication between the chamber and an exterior portion of the dispenser. A cartridge is provided that has an opening defined therein and is detachably engageable with the dispenser. The cartridge is adapted to substantially enclose the bag with at least a portion of the bag nozzle disposed in the opening. The cartridge is configured so that the opening is aligned with the passageway when the cartridge is fully engaged with the dispenser.

BRIEF DESCRIPTION OF THE DRAWINGS

The following detailed description of the preferred embodiments of the present invention will be better understood when read in conjunction with the appended drawings. For the purposes of illustrating the invention, there is shown in the drawings embodiments which are presently preferred. It is understood, however, that the invention is not limited to the precise arrangements and instrumentalities shown. In the drawings:

FIG. 19 is a cross-sectional view of a comestible product dispenser according to a second preferred embodiment of the present invention;

FIG. 20 is a front elevational view of the dispenser of FIG. 1 with an upper front panel removed;

FIG. 21 is a cross-sectional view of the dispenser of FIG. 19 as taken along the line 21—21 of FIG. 19 illustrating two cartridges, constructed according to a second preferred embodiment, contained therein;

DETAILED DESCRIPTION OF THE PREFERRED EMBODIMENTS

Figure 1:
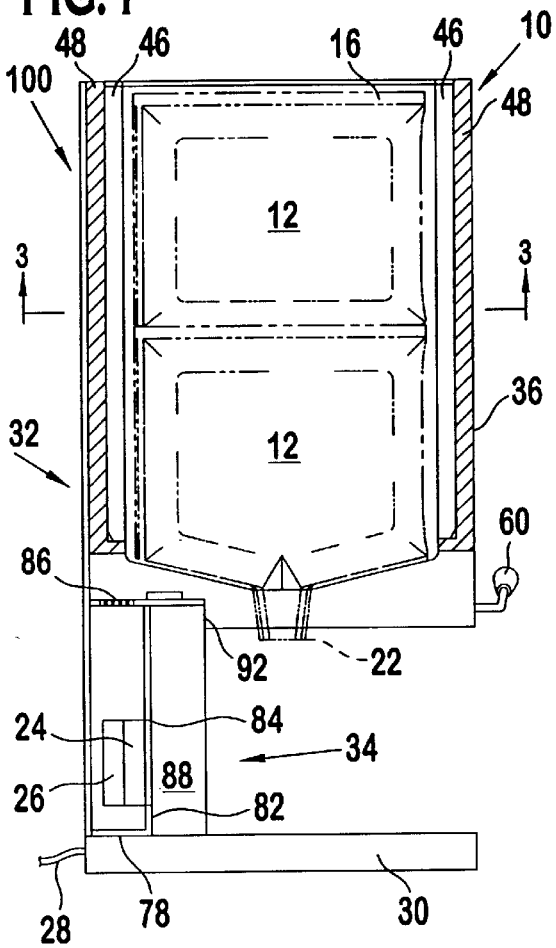
FIG. 1 is a cross-sectional view of a comestible product dispenser according to a first preferred embodiment of the present invention.
Figure 2:
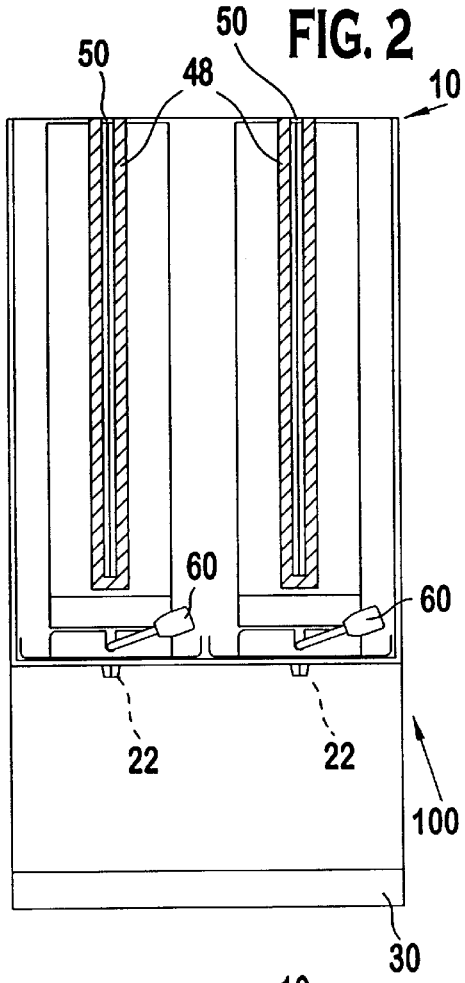
FIG. 2 is a front elevational view of the dispenser of FIG. 1 with an upper front panel removed.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the system for dispensing a viscous comestible product and designated parts thereof. The terminology includes the words above specifically mentioned, derivatives thereof and words of similar import. The word "a" as used in the claims and in the corresponding portions of the specification means "at least one."

Referring to the drawings in detail, wherein like numerals represent like elements throughout, FIGS. 1–18 illustrate a dispensing system according to a first preferred embodiment of the present invention, generally designated 100. FIGS. 19–23 illustrate a dispensing system according to a second preferred embodiment of the present invention, generally designated 100'. The system 100,100' is capable of receiving a bag 12 containing the viscous comestible product. The bag 12 includes a bag body 25 and a bag nozzle 22. A dispenser 10,10' supports the bag 12 of comestible product in a generally elevated position to facilitate dispensing, via gravity feed, of the viscous comestible product. The bag nozzle 22 through which the contents of the bag 12 are dispensed is located at the bottom of the bag 12. At least one protrusion 20 is disposed in the dispenser 10,10' to depress a side 27 of the bag 12 proximate to the nozzle 22 to facilitate comestible product flow through the nozzle 22. The protrusion 20 prevents the bag 12 from deforming proximate to the nozzle 22 such that it obstructs the flow of viscous comestible product through the nozzle 22.

Generally speaking, the first preferred embodiment of the dispenser 10 (further described below) is a top loading comestible product dispenser 10. Thus, the cheese bags 12 are inserted into the dispenser 10 by vertically inserting the cheese bags 12 into the dispenser 10 by removing a top panel of the dispenser 10. The second preferred embodiment of the dispenser 10' (further described below) is a front loading comestible product dispenser 10'. Thus, cheese bags 12 are inserted into the dispenser 10' by removing a front panel (or a L-shaped combination front and top panel) from the dispenser and inserting the cheese bags 12 generally horizontally into the dispenser 10'. Unless otherwise described below or shown in the drawings, it is preferred that the materials, configuration and operation of the second preferred embodiment of the dispenser 10' is the same as that described in connection with the first preferred embodiment of the dispenser 10.

The viscous comestible product used with the dispenser 10,10' is preferably, but not necessarily, a cheese sauce, or a cheese mixture. Those of ordinary skill in the art will appreciate from this disclosure that the dispenser 10,10' of the present invention can be used with various viscous comestible products, such as hot fudge, soft ice cream, caramel, milk, ketchup, mayonnaise, chili sauce or any other type of viscous food product, without departing from the scope of the present invention. When the dispenser 10,10' is used to dispense cheese sauce, it is preferred that the dispensed cheese sauce be maintained between approximately one hundred forty (140) degrees Fahrenheit and approximately one hundred sixty (160) degrees Fahrenheit. While it is preferred that the dispenser 10,10' be able to heat any comestible product contained therein, those of ordinary skill in the art will appreciate from this disclosure that the comestible products can be maintained at generally room temperature or in a refrigerated state by the dispenser 10,10' without departing from the scope of the present invention.

Referring to FIG. 1, the dispenser 10,10' preferably receives power, via a power cable 28, preferably connected to a standard ground fault circuit interrupt socket. The dispenser 10,10' preferably, but not necessarily, uses electrical power at one hundred twenty (120) volts alternating current and at sixty (60) hertz to power a fan 26 and a heating element 24. Those of ordinary skill in the art will appreciate from this disclosure that when the dispenser 10,10' is used with comestible products being served at room temperatures, the dispenser 10,10' can be operated without an outside power source without departing from the scope of the present invention. Similarly, a refrigerating unit (not shown) can be substituted for the heating element 24 depending upon the desired comestible product being dispensed without departing from the scope of the present invention. Alternatively, the dispenser can be powered by batteries or any other conventional means.

Figure 5:
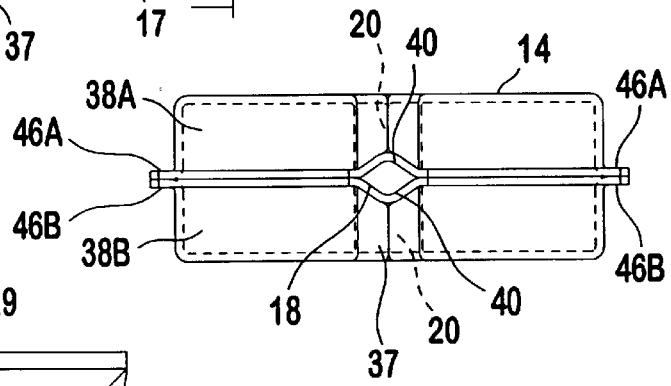
FIG. 5 is a bottom plan view of the cartridge of FIG. 4 illustrating first and second shells that are aligned to form the cartridge.
Figure 8:
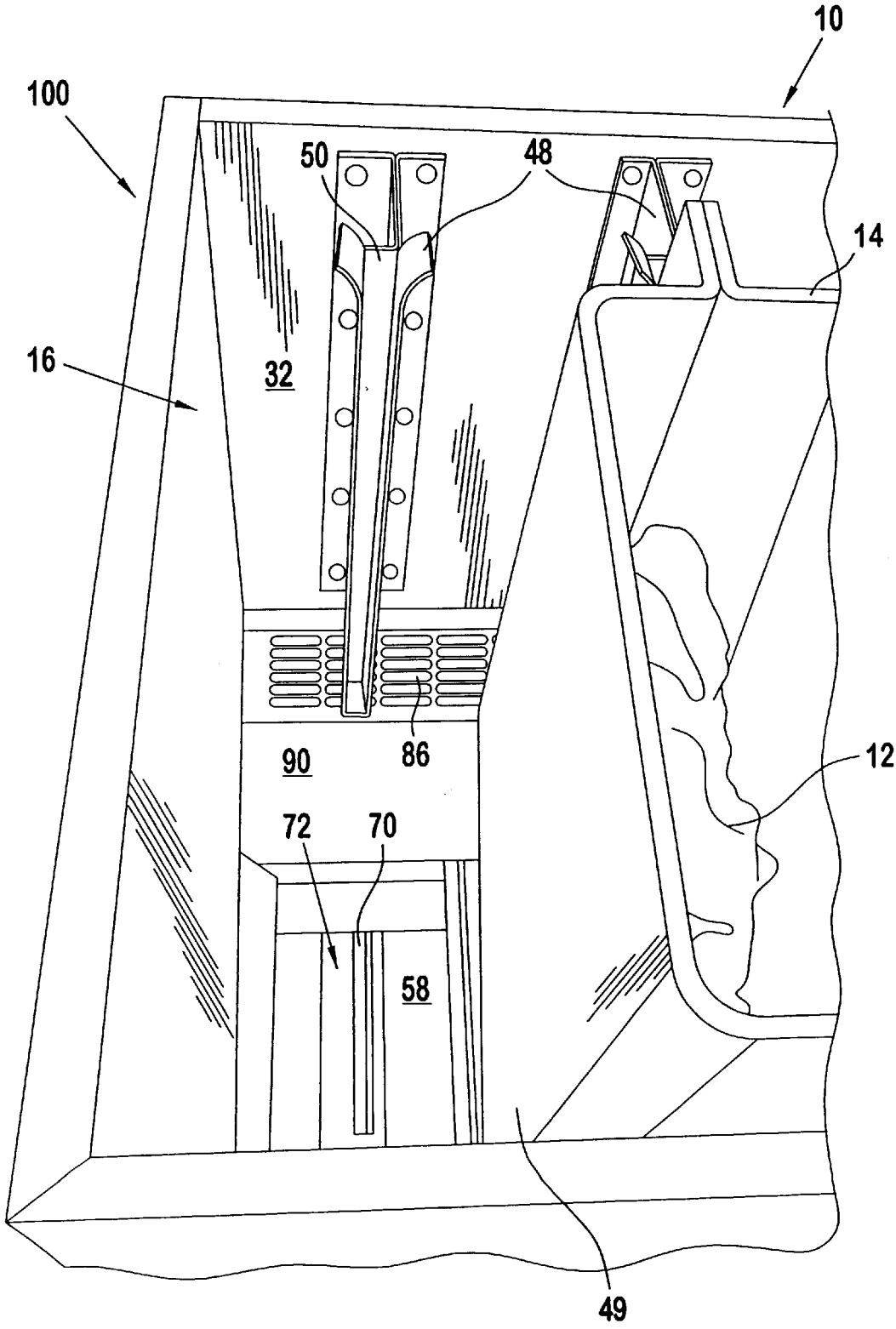
FIG. 8 is a partial top perspective view of the dispenser of FIG. 1 with the top of the dispenser and one cartridge removed.

As shown in FIG. 8, the dispenser 10,10' includes a dispenser body 32 that defines a chamber 16. The chamber 16 preferably, but not necessarily, includes at least one cartridge 14. Referring to FIG. 5, the first preferred embodiment of the cartridge 14 has a surface 37 with an opening 18 defined therein adapted to receive the bag nozzle 22. The opening 18 has a perimeter 39 and is preferably generally diamond or oval shaped. Alternatively, the opening 18 could be defined in the bottom surface of the dispenser body 32 and the cartridge 14 could be omitted.

Unless otherwise stated, the dispenser 10, 10' and its various components are preferably formed of a durable, high strength, material, such as galvanized steel or stainless steel. It is preferred, but not necessary, that the base 30 be formed of eighteen (18) gauge thickness material. It is also preferred that the panels used to form the body 32 of the dispenser 10 are formed of materials having a thickness of approximately twenty (20) or twenty-four (24) gauge. The body 32 of the dispenser 10 preferably has a double hulled configuration. It is preferred that the outer hull, or skin, be formed of stainless steel having a twenty-four (24) gauge thickness and that the inner skin be formed of either galvanized or stainless steel having a twenty (20) gauge thickness. However, those of ordinary skill in the art will appreciate from this disclosure that the present invention is not limited to a dispenser 10, 10' having panels of a particular thickness or material.

As best shown in FIGS. 1–3 and 19–21, the dispenser 10,10' preferably has a generally rectangular box shape. It is preferable, but not necessary, that the front of the dispenser 10,10' has a width of approximately ten (10) inches. The body 32 of the dispenser 10,10' extends upwardly from the base 30 of the dispenser 10,10'. The body 32 includes a narrow portion 34 that is interposed between the base 30 and an upper portion 36 of the body 32 that encloses the comestible product holding chamber 16. The narrow portion 34 of the body 32 is only attached over a portion of the top of the base 30. This allows items over which the comestible product will be dispensed to be positioned on the base 30 and underneath the nozzle 22 of a bag 12 disposed in the dispenser 10,10'.

It is preferable that the top surface of the base 30 has a generally rectangular shape and that the narrow portion 34 of the body 32 is aligned along one edge of the base 30. Additionally, it is preferable, but not necessary, that a perimeter of the upper portion 36 of the body 32 is the same as the perimeter of the base 30. As further detailed below, the narrow portion 34 of the body 32 preferably contains a heating system that heats and circulates air within the chamber 16 of the dispenser 10,10'.

Figure 3:
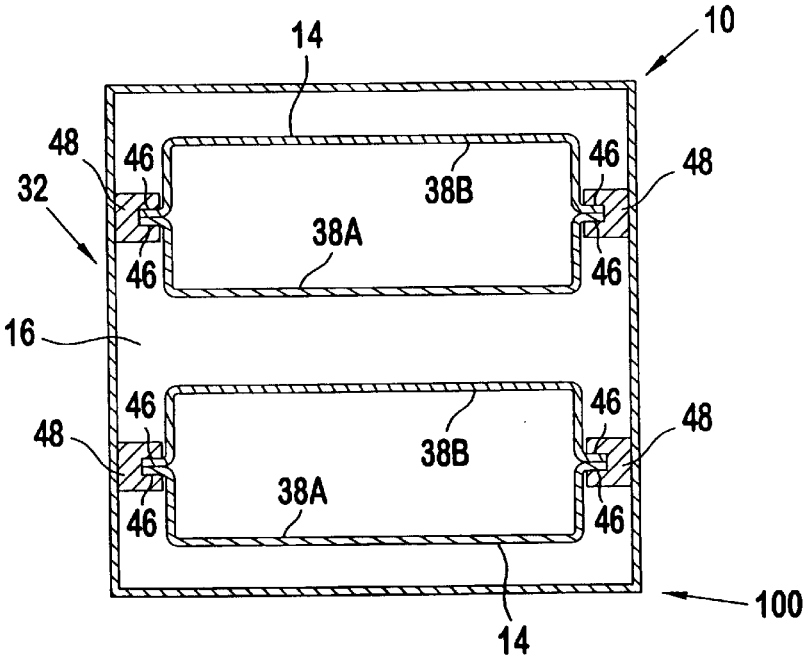
FIG. 3 is a cross-sectional view of the dispenser of FIG. 1 as taken along the line 3—3 of FIG. 1 illustrating two cartridges, constructed according to a first preferred embodiment, contained therein.
Figure 4:
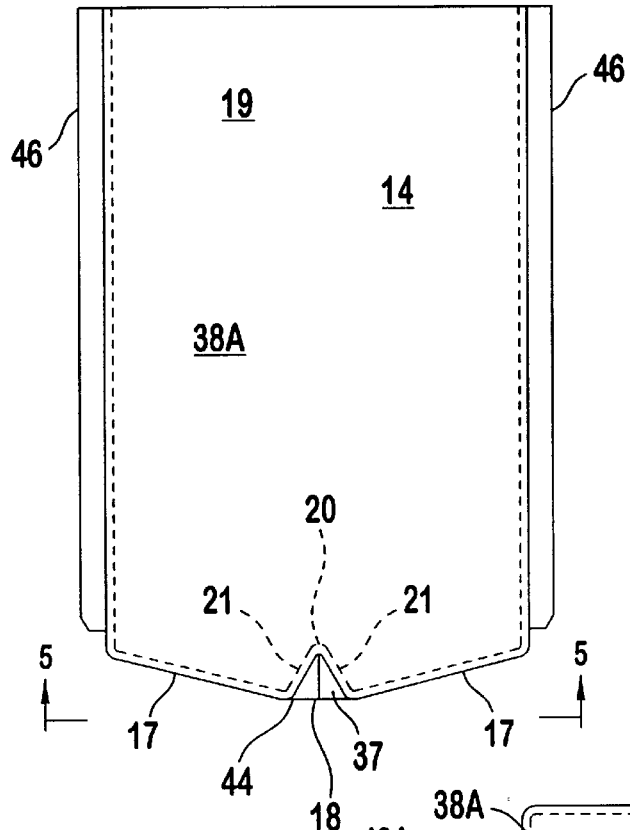
FIG. 4 is a front elevational view of one of the cartridges of FIG. 3 removed from the dispenser FIG. 1.

Referring to FIGS. 3 and 21, the chamber 16 preferably has a generally rectangular perimeter and extends substantially throughout the upper portion 36 of the body 32 of the dispenser 10,10'. Those of ordinary skill in the art will appreciate from this disclosure, that the particular shape of the chamber 16 can be varied without departing from the scope of the present invention. For example, the chamber 16 may have a circular, polygonal, or an irregular shaped perimeter without departing from the scope of the present invention.

Referring to FIGS. 1 and 19, the bags 12 are preferably inserted into the chamber 16 so that the nozzle 22 is positioned past the bottom of the upper portion 36 of the dispenser 10,10'. It is preferable, but not necessary that multiple bags 12 are stacked inside the chamber 16 of the dispenser 10,10' to apply pressure to the lowest bag 12 and to facilitate the evacuation of comestible product from the lowest bag 12. Additionally, the placement of additional bags 12 within the dispenser 10,10' allows the dispenser 10,10' to preheat the bags 12 prior to use.

Figure 6:
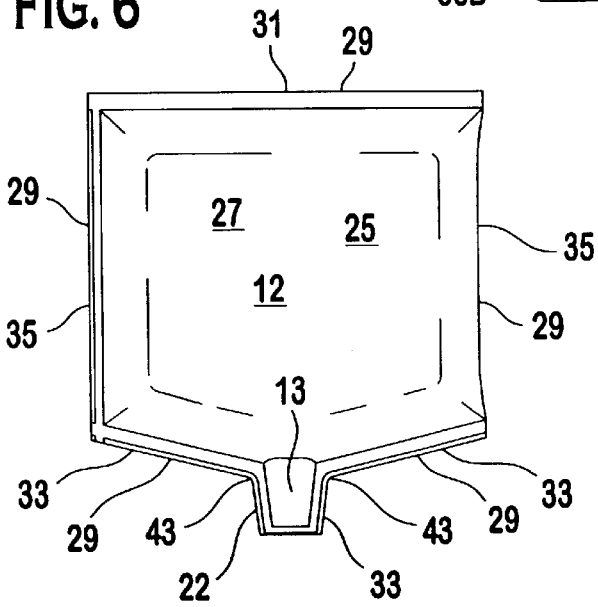
FIG. 6 is a front elevational view of a fitmentless bag preferably used with the dispenser of FIG. 1.
Figure 18:
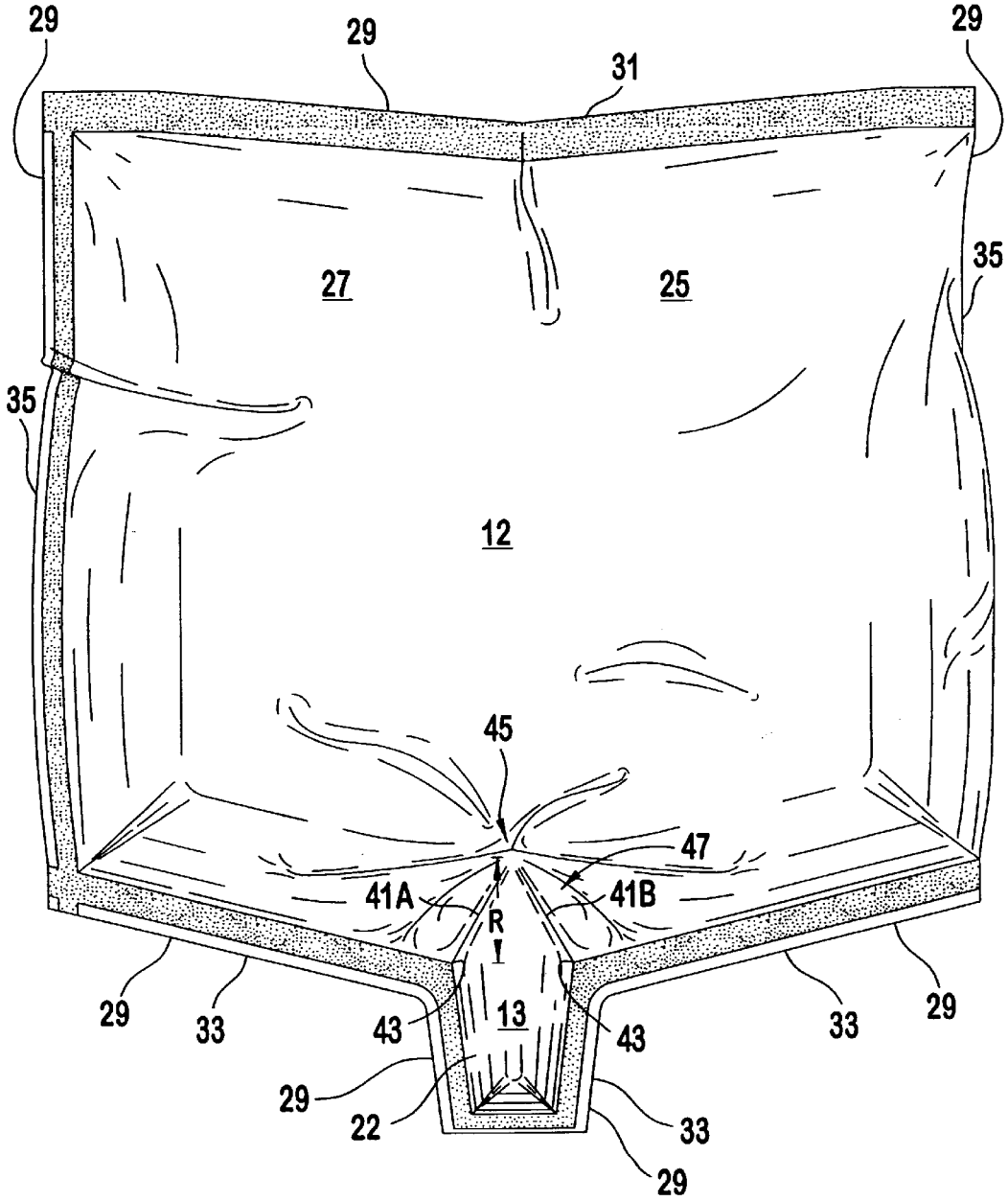
FIG. 18 is a front elevational view of bag of FIG. 6 illustrating one preferred position of the bag when the bag is configured, or deformed, by the cartridge protrusion into a position facilitating the flow of viscous comestible product therefrom.

Referring to FIGS. 6 and 18, it is preferable, but not necessary, that the bags 12 used with the present invention are free of fitments, attached tubes or other separate dispensing devices. Instead, the bag 12 is preferably formed as a single, shaped pouch having a narrow nozzle-shaped strip that serves as the nozzle 22. It is preferred that the bag 12 is formed by two flexible sides 27 connected together around a periphery 29 of the two flexible sides 27. The periphery 29 includes a top edge 31, a bottom edge 33, and two side edges 35. The bottom edge 33 preferably integrally forms the bag nozzle 22 with the bag body 25. The bag 12 is preferably formed from a durable, heat resistant polymer using a single folded over sheet or two sheets of polymeric material that are sealed together along the perimeter 29 to form the bag 12.

The bags 12 preferably, but not necessarily, have three sides forming three sides of a rectangle. The fourth side of the bag 12 preferably has a generally triangular shape with the nozzle 22 extending from an outwardly extending apex of the fourth side. While the present invention is particularly suited for use with fitmentless bags 12, those of ordinary skill in the art will appreciate from this disclosure that bags 12 having fitments (not shown) can be used with the dispenser 10, 10' without departing from the scope of the present invention.

Figure 22:
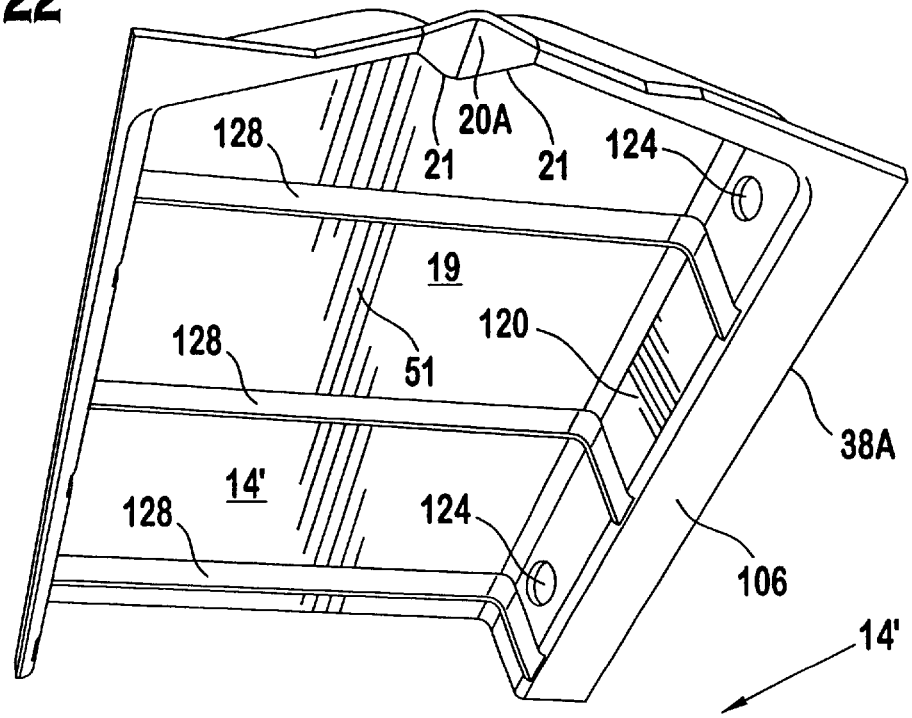
FIG. 22 is an exploded perspective view of one of the cartridges of FIG. 21.
Figure 22:
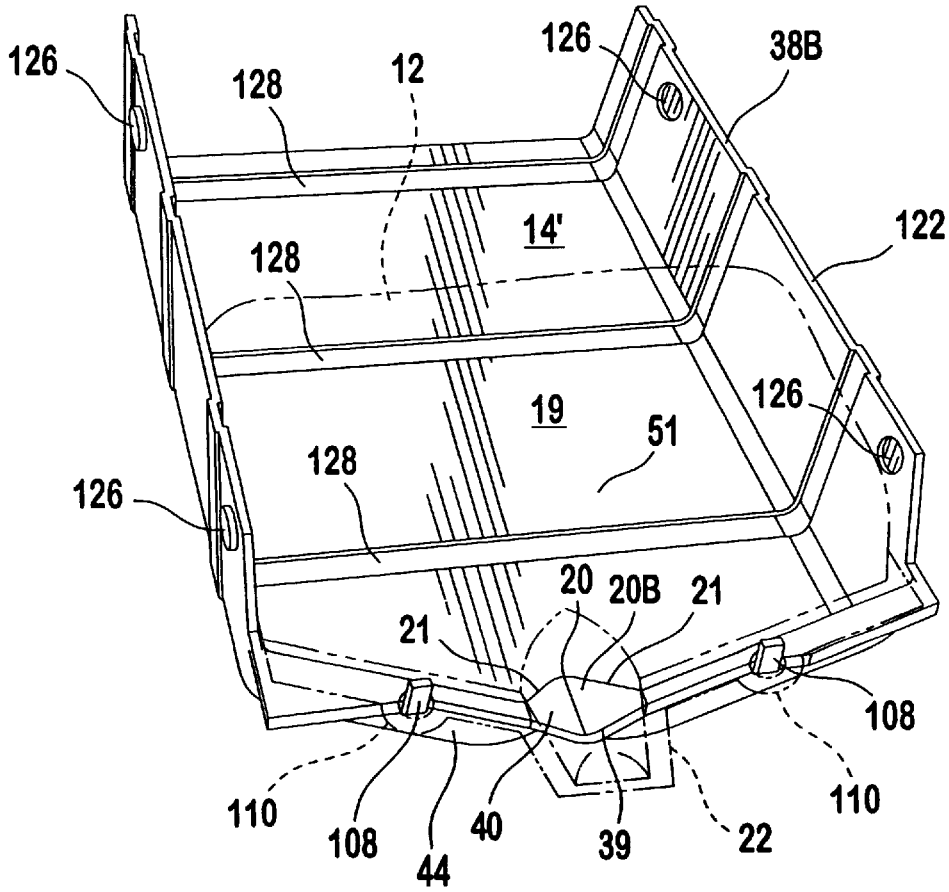
Figure 23:
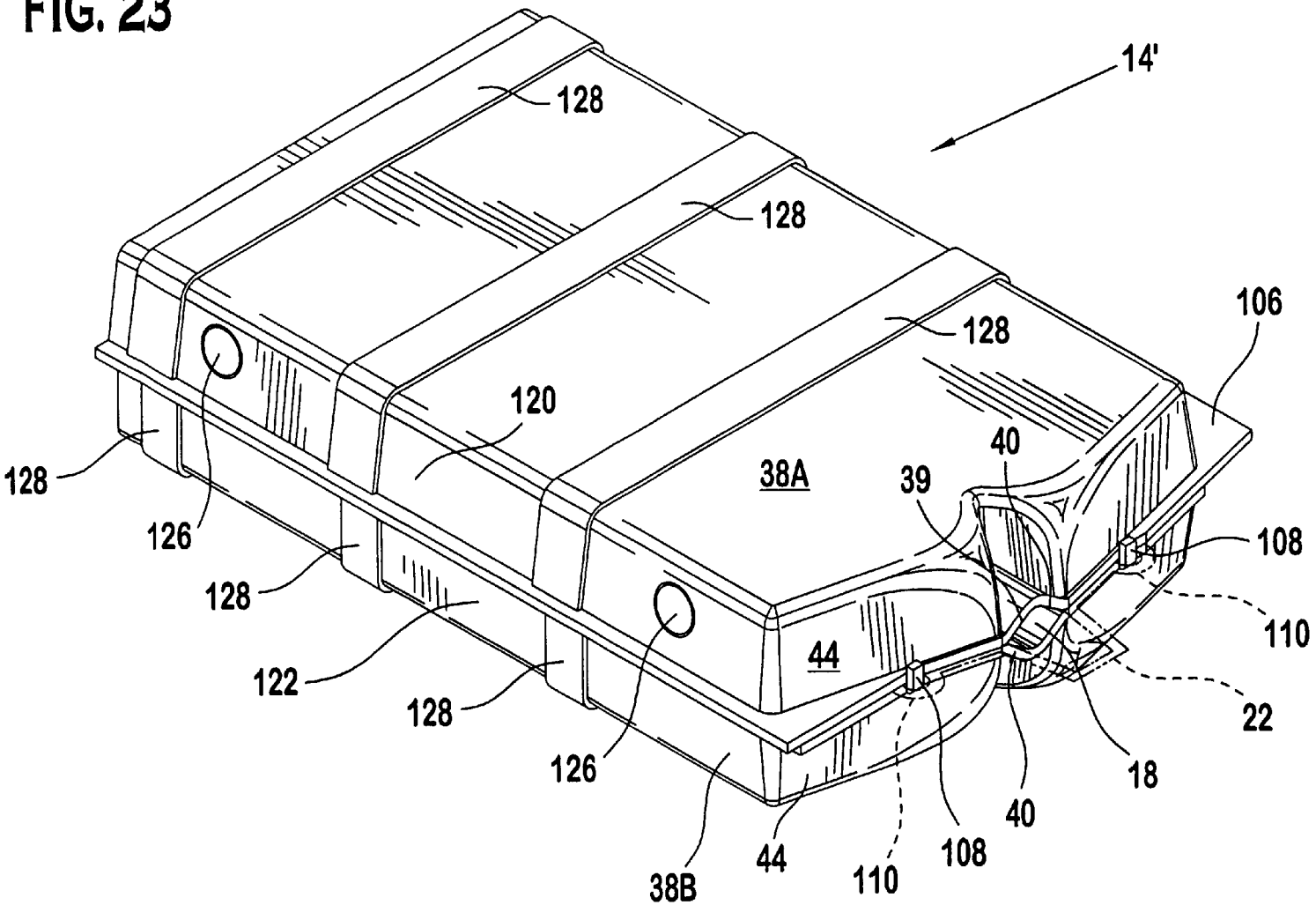
FIG. 23 is a perspective view of one of the cartridges of FIG. 21.

Referring to FIGS. 22 and 23, in which the bag 12 is shown in phantom lines, the bag 12 may include loops 110 that can be slid over pins 108, such as those incorporated into the second preferred embodiment of the cartridge 14' (further described below). The bag loops 110 facilitate the proper alignment of the bag 12 within the cartridge 14' by forcing the bag nozzle 22 to be properly positioned prior to attaching the first and second cartridge sides 38A, 38B (further described below). While not shown, those of ordinary skill in the art will appreciate that pins 108 can be used in conjunction with the first preferred embodiment of the cartridge 14 (further described below) without departing from the scope of the present invention. Similarly, the pins 108 can be omitted from the second preferred embodiment of the cartridge 14' without departing from the scope of the present invention.

Due to the flexible nature of the bags 12 that are preferably used to contain the comestible product, the bag 12 tends to crimp proximate to where the nozzle 22 extends from the bag 12. Such crimping obstructs the flow of the comestible product through the nozzle 22. Referring to FIGS. 9, 13, 17 and 22, to prevent the crimping of the bag 12, a protrusion 20 is positioned proximate at least one, and preferably proximate both, major surfaces 13 of the nozzle 22 to encourage the bag 12 to deform so that the nozzle 22 is unobstructed. Thus, the dispenser 10,10' of the present invention can use fitmentless bags while providing good dispenser efficiency. This allows the dispenser 10,10' to be used with bags that are cheaper to manufacture than bags having fitments, attached tubes or other separate dispensing devices. Accordingly, the operating costs of the dispenser 10,10' of the present invention can be lower than that of conventional dispensers.

As best shown in FIGS. 1 and 8, it is preferred, but not necessary, that the bag 12 is mounted within the first preferred embodiment of the dispenser 10 using the cartridge 14. Referring to FIGS. 4, 5, 9–15 and 17, the first preferred embodiment of the cartridge 14 preferably includes the opening 18 defined therein and is detachably engageable with the dispenser 10. The cartridge 14 is adapted to substantially enclose a portion of the bag 12 with at least a portion of the bag nozzle 22 disposed in the opening 18.

Referring to FIGS. 1 and 19, it is preferable, but not necessary, that the cartridge 14,14' be configured to receive a second bag 12 of viscous comestible product on top of the first bag 12, which includes the nozzle 22 aligned with the opening 18, to allow the second bag 12 to preheat. The cartridge 14,14' is configured so that the opening 18 is aligned with a passageway through the dispenser 10 when the cartridge 14 is fully engaged with the dispenser 10.

It is preferred that the cartridge 14,14' be formed of a heat resistant durable polymer, such as a food grade polycarbonate or a food grade acrylic. It is preferable, but not necessary, that the cartridge 14 be formed of generally transparent material to facilitate the monitoring of bags 12 positioned therein.

The cartridges 14, 14' may also have textured inner walls. This prevents the bags from sticking to the inner walls of the cartridges 14, 14' which can occur with smooth inner walls. The texture may be formed by abrading a smooth surface, such as by abrasive blasting, or may be formed in the surfaces.

Referring to FIGS. 5, 13–15,17,22 and 23 the cartridge 14,14' is preferably formed by first and second shells 38A, 38B. The two shells 38A, 38B are preferably generally symmetrical and can be used to sandwich at least a portion of a bag 12 therebetween. Those of ordinary skill in the art will appreciate from this disclosure that the cartridge 14 may be formed as a one-piece cartridge without departing from the scope of the present invention.

By forming the cartridge 14,14' using first and second shells 38A, 38B, bags 12 can be properly positioned and oriented on one of the cartridge shells 38A, 38B before completing the assembly of the cartridge 14,14'. This simplifies the proper placement of the nozzle 22 of the bag 12 within the cartridge opening 18 that is formed by the groove 40 defined in each of the cartridge shells 38A, 38B. The shells 38A, 38B may be separate pieces which remain loose, or may be clamped together by suitable clips, screws, a snap lock connection (such as that described below in connection with cartridge 14' of the second preferred embodiment) or other means.

Figure 9:
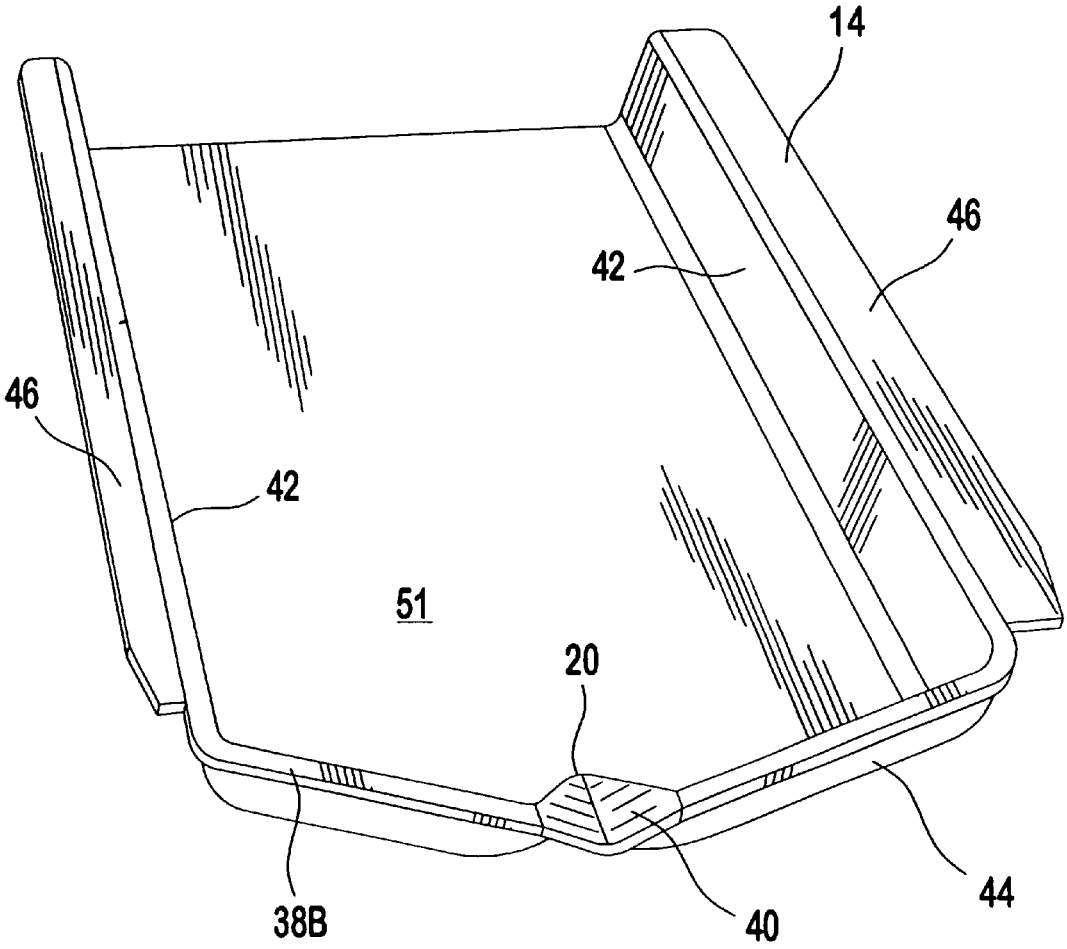
FIG. 9 is a front perspective view of the second shell of the cartridge of FIG. 4.
Figure 10:
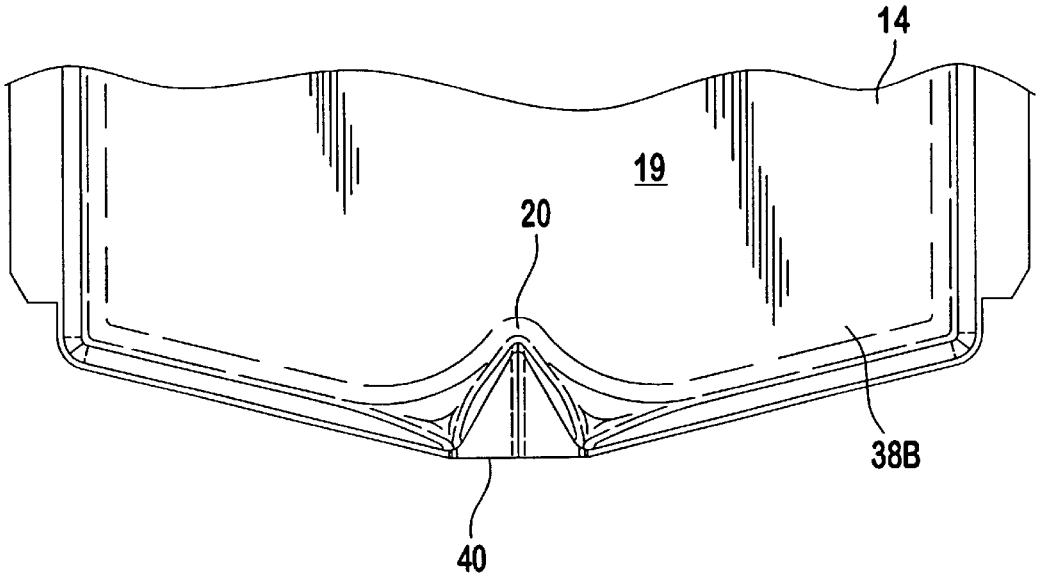
FIG. 10 is a partial rear elevational view of the second shell of the cartridge of FIG. 4.
Figure 11:
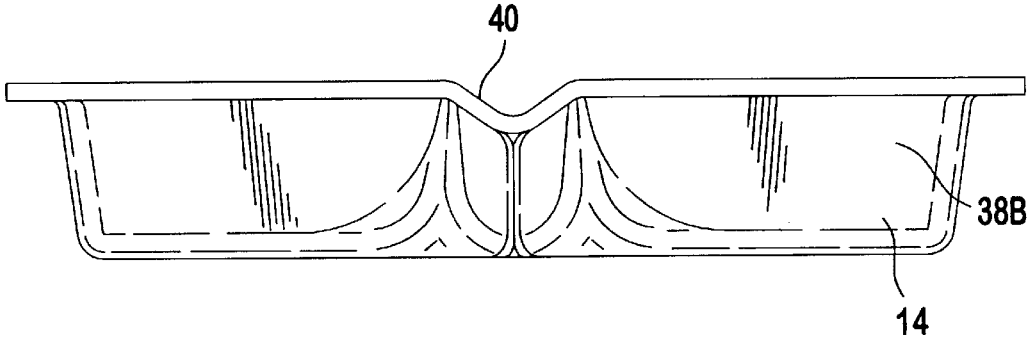
FIG. 11 is a bottom plan view of the second shell of the cartridge of FIG. 5.
Figure 12:
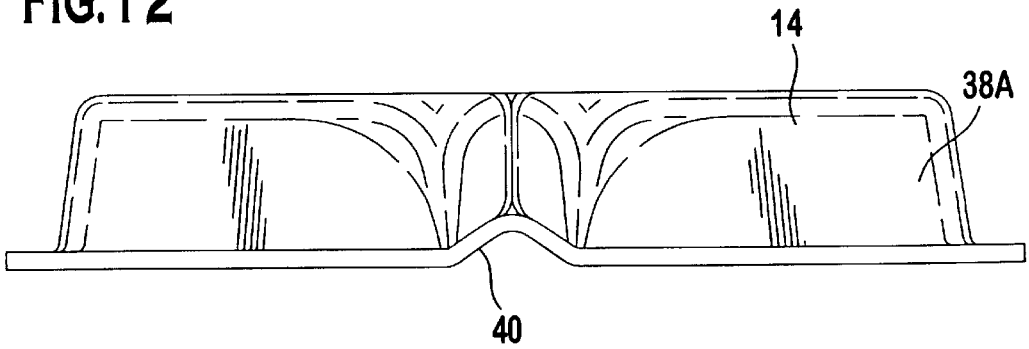
FIG. 12 is a bottom plan view of the first shell of the cartridge of FIG. 5.

As best shown in FIGS. 9 and 22, it is preferred, but not necessary, that each of the shells 38A, 38B of the cartridge 14,14' have a generally rectangular shape. As shown in FIG. 9, referring only to the first preferred embodiment of the cartridge 14, longitudinal side walls 42 preferably extend generally perpendicularly from opposing edges of each cartridge shell 38A, 38B. The longitudinal side walls 42 are connected along one end by a bottom side wall 44 which has a generally triangular shape with an apex positioned roughly equidistant between the longitudinal side walls 42. Thus, when the cartridge shells 38A, 38B are assembled to form a cartridge 14, the bottom of the cartridge 14 has generally angled sides 17 to facilitate the evacuation of the comestible product from the bag 12. The particular angle of the angled sides 17 of the cartridge 14 can be varied depending upon the characteristics of the bag 12 used with the cartridge 14 without departing from the scope of present invention.

Figure 15:
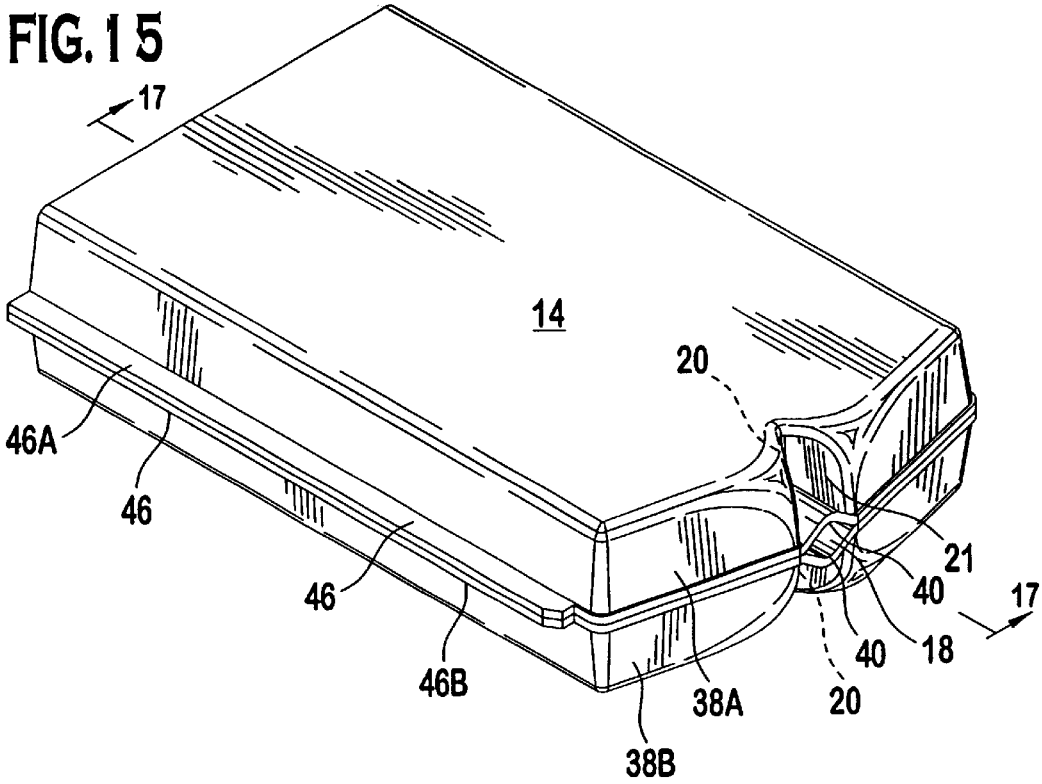
FIG. 15 is a perspective view of the cartridge of FIG. 4.

As best shown in FIGS. 8, 9 and 15, the first preferred embodiment of the cartridge 14 preferably has at least one guide flange 46 that is engageable with the dispenser body 32. When the cartridge 14 is formed using two halves, the first and second cartridge shells 38A, 38B each preferably have a separate guide flange 46 (also referred to as first and second flanges 46A, 46B). The first shell 38A preferably has a first flange 46A located along one side and the second shell 38B preferably has a second flange 46B located along one side. When the first shell 38A is aligned with the second shell 38B to allow the cartridge 14 to substantially enclose the bag 12 therein, the first flange 46A is preferably aligned with the second flange 46B. It is more preferable that the first shell 38A have a pair of first flanges 46A located along opposing sides and that the second shell 38B have a pair of second flanges 46B located along opposing sides. When the first and second shells 38A, 38B are aligned to enclose a bag 12 therein, the pair of first flanges 46A are preferably aligned with the pair of second flanges 46B.

Guide flanges 46 extend generally perpendicularly from each of the longitudinal side walls 42 of the first and second cartridge shells 38A, 38B. When placing the two sides 38A, 38B of the cartridge 14 together, the guide flanges 46 of the respective sides 38A, 38B are aligned to allow the cartridge 14 to be slidably inserted into the chamber 16 of the dispenser 10.

While it is preferable that the first and second flanges 46A, 46B align in a generally adjacent and overlapping manner, those of ordinary skill in the art will appreciate from this disclosure that the first and second flanges 46A, 46B can be configured to be vertically aligned end to end (not shown) when viewed in a top plan perspective (similar to that shown in FIG. 13) without overlapping.

Referring to FIGS. 1–3 and 8, the dispenser body 32 preferably includes a channel member 48 capable of receiving the guide flanges 46, or the first and second flanges 46A, 46B, of the first and second cartridge shells 38A, 38B. When the cartridge 14 includes first and second pairs of flanges 46A, 46B, it is preferable that the dispenser body 32 include a pair of channel members 48 each engageable with both one of the pair of first flanges 46A and one of the pair of second flanges 46B. The channel members 48 are preferably vertically disposed along the inner surface of the chamber 16 to secure the cartridge 14 therebetween. Each of the channel members 48 forms a slot 50 for receiving a guide flange(s) 46 of the cartridge 14. Thus, the cartridges 14 simplify the positioning of multiple bags 12 within the chamber 16.

The second preferred embodiment of the cartridge 14', shown in detail in FIGS. 21–23, uses first and second cartridge sides 38A, 38B having longitudinal side walls 120,122. The longitudinal side walls 122 on one or both cartridge sides 38A, 38B preferably extend outwardly from the major cartridge surface more than half the thickness of the assembled cartridge 14'. This allows the longitudinal cartridge sides 122 to be inserted between longitudinal cartridge sides 120 of the first cartridge side 38A. The longitudinal cartridge sides 122 of the second cartridge side 38B each preferably include at least one plug 126 which extends generally outwardly from it respective longitudinal side 122.

The first cartridge side 38A of the cartridge 14' has longitudinal cartridge sides 120 which preferably include at least one hole 124 correspondingly positioned to receive the plug 126 from the corresponding longitudinal cartridge side 122 of the second cartridge side 38B when the cartridge 14' is assembled. By depressing the plugs 126, the longitudinal cartridge sides are deflected inwardly to allow the first cartridge side 38A to be disengaged from the second cartridge side 38B to open the cartridge 14'.

As best shown in FIG. 23, to insert a bag 12 into the cartridge 14', the plugs 126 extending from the longitudinal cartridge sides 122 are depressed allowing the first cartridge side 38A to be lifted off of the second cartridge side 38B as shown in FIG. 22. Then, the bag 12 is positioned with the nozzle 22 generally extending over the perimeter 39 of one half of the cartridge opening 18. Then, to more precisely locate the position of the bag nozzle 22, bag loops 110 are positioned over pins 108. By positioning the bag 12 such that the loops 110 are located over the pins 108, the bag nozzle 22 is properly aligned to extend through the opening 18 in the assembled cartridge 14'. Once the bag 12 is properly positioned on the second cartridge side 38B, the first cartridge side 38A is slid over the longitudinal sides 122 of the second cartridge side 38B until the plugs 126 of the second cartridge side 38B engage the holes 124 in the longitudinal sides 120 of the first cartridge side 38A. Once the cartridge 14' is fully assembled, with the bag nozzle 22 extending through the opening 18, the cartridge 14' is ready for insertion into the dispenser 10' (further described below). Additionally, the use of plugs 126 and holes 124 in the longitudinal cartridge sides 120, 122 simplifies the insertion of the cartridge 14' by preventing an operator from having to hold the cartridge sides 38A,38B together while loading the cartridge 14' into the dispenser 10'.

Referring to FIGS. 19, 21 and 22, the second embodiment of the cartridge 14' may optionally include an alignment fin 106. The alignment fin 106 can be used to prevent operators from loading the cartridge 14' into the dispenser 10' in a backwards orientation. However, the alignment fin 106 is not necessary and may be omitted. As best shown in FIG. 21, if used, the alignment fin 106 extends leftwardly from the cartridge 14' a distance greater than a second distance (illustrated as "X" in FIG. 21) measured between the right side of the dispenser 10' and the right side of the cartridge 14'. Thus, if the cartridge 14' were to be inserted backwards into the dispenser 10', the alignment fin 106 would prevent the closure of the front panel of the dispenser 10'. It is preferable, but not necessary, that the top panel be joined with the front panel so that a L-shaped member is detachable for insertion and removal of the cartridges 14'. Each cartridge 14' is preferably secured in place using a combination rear bracket 102 and bottom bracket 101. Referring to FIG. 20, the bottom bracket 101 forms a generally U-shaped guide capable of receiving the cartridge 14' and capable of providing lateral support to the bottom portion of the cartridge 14'. Referring to FIG. 21, the rear bracket 102 extends rightwardly into the chamber 16 an then, forms a shoulder 104 against which the cartridge 14' is secured.

The shoulder is preferably generally parallel to and spaced from the left side of the dispenser 10'. Before the rear bracket forms the shoulder 104, the rear bracket 102 extends outwardly a distance sufficient to prevent the alignment fin 106 from contacting the left side of the dispenser 10'. It is preferable, that rear bracket portion 105 extend along a portion of the major side surfaces of the cartridge 14'. The combination of the rear bracket shoulder 104 and the rear bracket portions 105 preferably form a sleeve into which one end of the cartridge 14' can be inserted. The rear brackets 102 preferably include angled ends 107. The rear bracket angled ends 107 allow the sleeve that is formed by the rear bracket 102 to be outwardly deflected to facilitate the insertion of the cartridge 14' into the bracket 102. The angled rear bracket ends 107 allow the cartridge 14' and the rear bracket 102 to be sized to create an interference fit. When an interference fit is formed between the cartridge 14' and the bracket 102, the bracket portions 105 apply a compressive force to opposite sides of the cartridge 14' once the cartridge 14' is inserted into the dispenser 10'. Those of ordinary skill in the art will appreciate from this disclosure, that the rear bracket 102 can extend along the entire length of the rear side of the cartridge 14' or along a portion, or portions, of the rear side of the cartridge 14' without departing from the scope of the present invention.

While it is preferred that the second preferred embodiment of the cartridge 14' be loaded using an alignment fin 106 and bottom and rear brackets 101, 102, those of ordinary skill in the art will appreciate from this disclosure, that the second preferred embodiment of the cartridge 14' can be top loaded using an engagement system similar to that described above in connection with the first preferred embodiment of the cartridge 14.

Referring to FIGS. 1 and 21, multiple cartridges 14,14' can be positioned within the dispenser 10,10' without departing from the scope of the present invention. It is preferable, but not necessary, that the dispenser 10,10' include a second cartridge 14,14' bearing a second opening 18 and being detachably engaged with the dispenser 10,10'. The second cartridge 14,14' is preferably adapted to substantially enclose a second bag 12 for dispensing with at least a portion of the second bag nozzle 22 disposed in the second opening 18. The second cartridge 14,14' is preferably configured so that the second opening 18 is aligned with a second passageway in the dispenser 10,10' and so that the first and second cartridges 14,14' are engageable with the dispenser 10,10' in a side-by-side alignment.

As best shown in FIGS. 9, 13, 17 and 22, it is preferred that a first protrusion 20A be disposed proximate to the perimeter 39 of the cartridge opening 18. The first protrusion 20A extends from the surface 37 generally inwardly into the chamber 16 and is adapted to abut and flex the bag body 25 into a configuration (a preferred configuration is shown in FIG. 18) facilitating a flow of the viscous comestible product therefrom. A second protrusion 20B is preferably, but not necessarily, disposed on the surface 37 of the chamber 16 proximate to the perimeter 39 of the opening generally opposite from the first protrusion 20A. When used together, the first and second protrusions 20A, 20B extend generally inwardly into the chamber 16 from the surface 37 and are adapted to abut generally opposing sides 27 of the bag body 25.

As best shown in FIGS. 1, 5, 9, 15 and 19, the chamber 16 preferably includes a cartridge 14,14' having an exterior surface and an interior 51. The cartridge 14,14' is preferably removably disposed in the body 32 and a portion of the cartridge interior 51 preferably forms the surface 37 with the first protrusion 20A. It is preferred that a separate protrusion 20 be positioned proximate to each cartridge groove 40 to deform the bag 12 to prevent the obstruction of comestible product flow through the bag nozzle 22.

As best shown in FIGS. 4, 9, 13 and 22, it is preferable, but not necessary, that the protrusions 20 extend generally upwardly from the bottom sidewall 44 (as viewed in FIGS. 4 and 22) to form a generally triangular shape (or V-shape). The apex of the generally triangular shaped protrusion extends from a position generally above one edge of the opening 18 and extends generally outwardly to a major surface 19 of the respective cartridge side 38A, 38B.

Lateral sides 21 of each protrusion 20 are preferably angled and sized as follows. Depending upon the contents and materials used to form the bag 12, pressure applied a given distance from the nozzle 22 of the bag 12 will prevent the crimping of the bag 12 proximate to the nozzle 22. Once the appropriate distance, as measured from the nozzle juncture with the bag 12, for preventing crimping of the nozzle is determined, the sides 21 of the bag 12 are pressed inwardly at the appropriate distance and the bag 12 is observed to determine how the bag 12 deforms. Once the sides 21 of the bag 12 are properly depressed to maximize nozzle flow, the deformation of the bag 12 represents the properly deformed position for the bag. The lateral sides 21 of the protrusion 20 are configured to support the bag 12 in the properly deformed position to prevent crimpage of the nozzle 22.

Referring to FIGS. 18 and 22, the first protrusion 20A (if desired a second protrusion 20B can also be used to configure the bag 12) is adapted to abut the bag 12 to form first and second crease lines 41A, 41B in the bag body 25 that each extend approximately from a separate side 43 of the bag nozzle 22, proximate to where the bag nozzle 22 extends from the bag body 25, toward an apex 45 to form a generally V-shape 47. When the V-shape 47 is viewed with the nozzle 22 extending downwardly from the bag 12 (as shown in FIG. 18), then it is preferable that the V-shape 47 be oriented generally upside down and the first and second crease lines 41A, 41B extend generally upwardly at an angle.

It is preferable that the first protrusion 20A (optionally in combination with the second protrusion 20B) be configured to position, or deform, the bag 12 such that a distance "R" between where the bag nozzle 22 extends from the bag body 25 and the apex 45 is between approximately one quarter (0.25) of an inch and approximately five (5) inches. It is more preferable that the distance "R" be between approximately one quarter (0.25) of an inch and approximately two (2) inches. It is more preferable still that the distance "R" be between approximately one half (0.5) of an inch and approximately one (1) inch.

Figure 13:
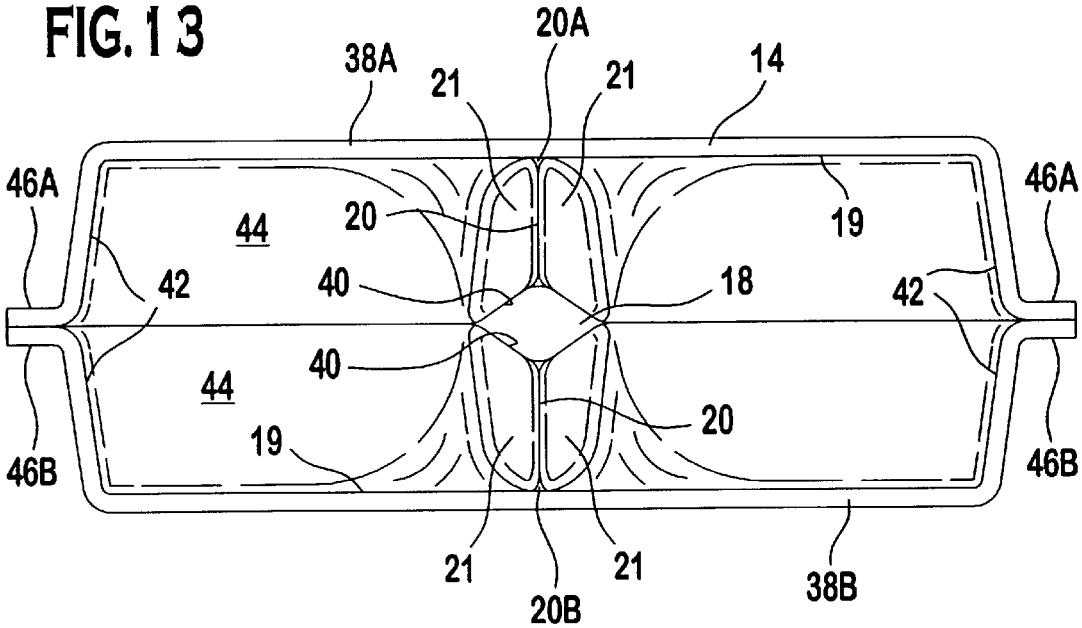
FIG. 13 is a top plan view of the cartridge of FIG. 4 illustrating first and second protrusions located proximate to a cartridge opening.
Figure 17:
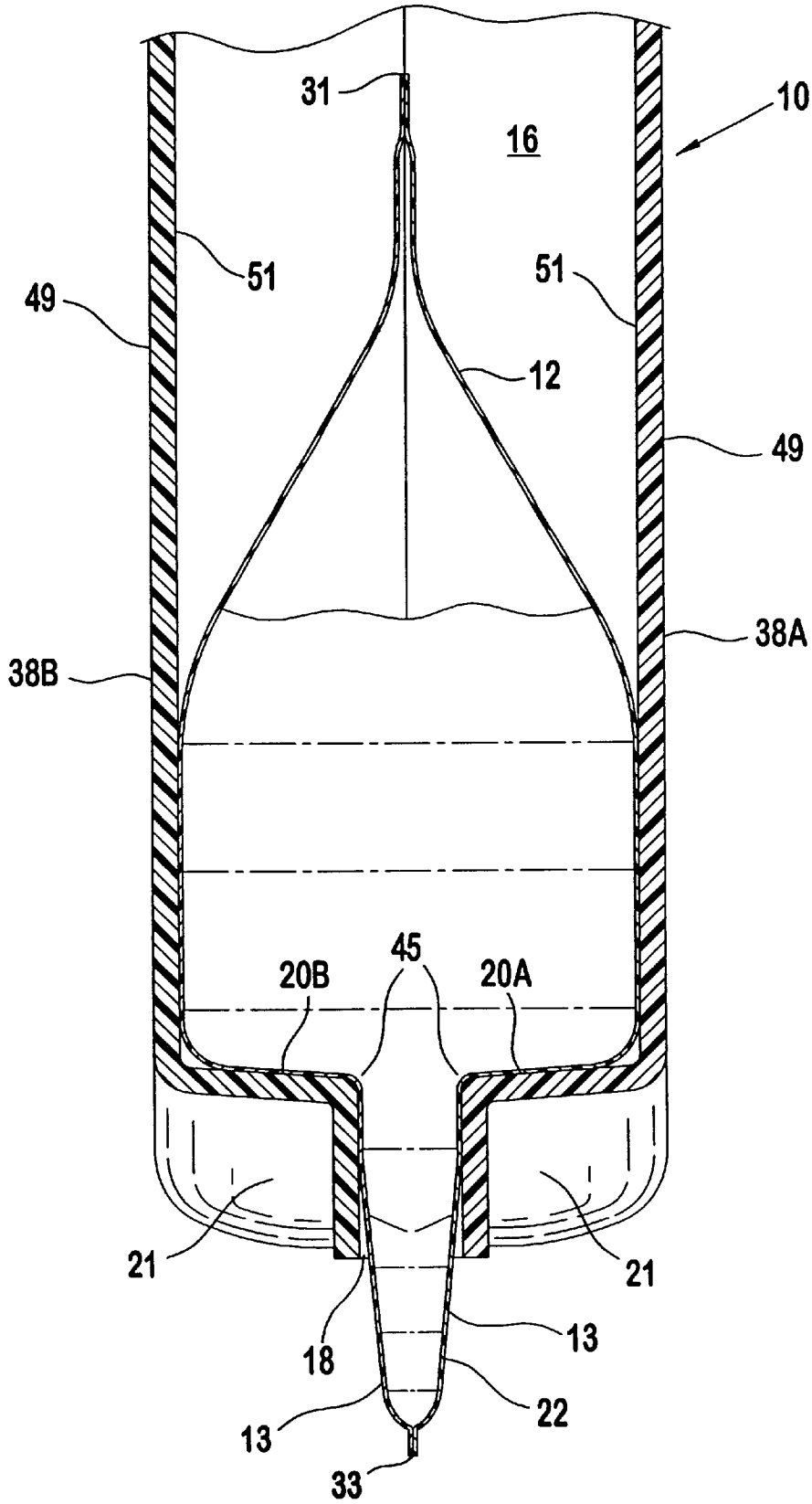
FIG. 17 is a cross-sectional view of a bag of viscous comestible product located in the cartridge viewed in a similar manner as that shown by line 17—17 in FIG. 15.

Referring to FIGS. 13, 17 and 23, when the dispenser 10,10' includes first and second protrusions 20A, 20B, the spacing between the opposing protrusions 20 (as measured from the inner edges that are aligned generally over a portion of the opening perimeter) is preferably between approximately one half (0.5) of an inch and approximately two (2) inches, and more preferably between 0.9 and 1.5 inches, to ensure that appropriate pressure is applied to the sides 27 of the bag 12. Those of ordinary skill in the art will appreciate from this disclosure that the distance between opposing protrusions 20 can be varied depending upon the type of bags 12 used without departing from the scope of the present invention.

While it is preferred that the protrusions 20 have a generally triangular shape (when viewed from the perspective shown in FIGS. 4 and 9), those of ordinary skill in the art will appreciate from this disclosure that the protrusions 20 can have a rounded shape (not shown) or the like without departing from the scope of the present invention. It is preferred, but not necessary, that the protrusions 20 extend between approximately one half (½) of an inch and one (1) inch above the bottom side wall 44 of the cartridge 14.

Figure 14:
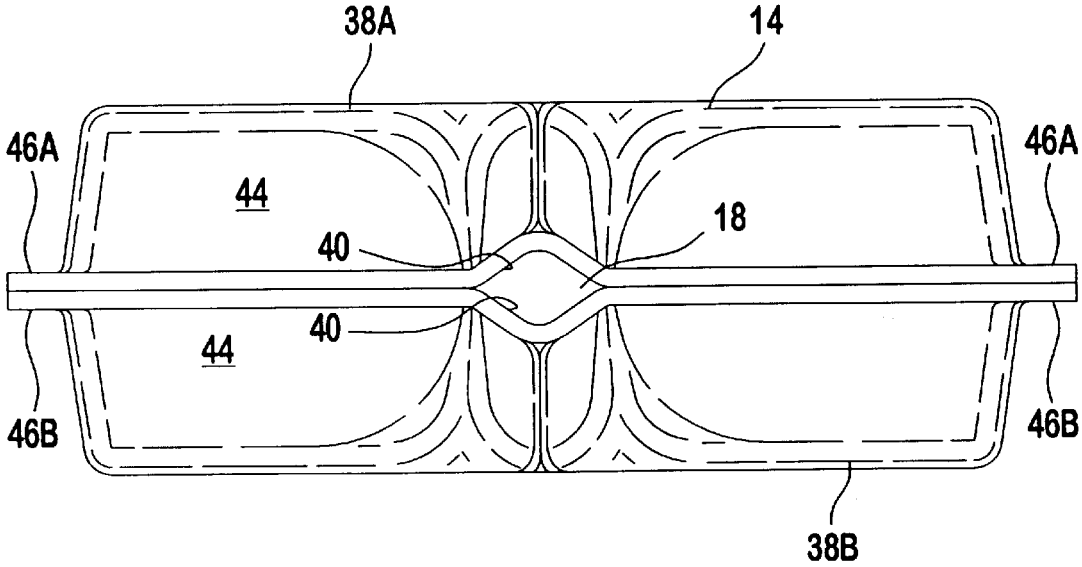
FIG. 14 is an enlarged bottom plan view of the cartridge of FIG. 4.

Referring to FIGS. 5, 14 and 22, it is preferred that the grooves 40 in the first and second shells 38A, 38B that form the cartridge opening 18 when the first and second shells 38A, 38B are aligned are shaped so that the opening 18 is generally diamond or oval shaped. Those of ordinary skill in the art will appreciate that the grooves 40 can be shaped such that the opening 18 in the cartridge 14,14' has a circular shape, irregular shape or the like without departing from the scope of the present invention.

Referring to FIGS. 1–3, 8 and 19–21, while it is preferred that the dispenser 10,10' use cartridges 14 to position the bags 12 within the chamber 16, those of ordinary skill in the art will appreciate from this disclosure that the dispenser 10,10' can directly receive the bag 12 within the chamber 16 without using a cartridge mounting system. When the bags 12 are directly inserted into the chamber 16, protrusions 20 (similar to those described above) are preferably positioned on the bottom surface of the chamber 16 to deform the bag 12 and to prevent the obstruction of flow through the nozzle 22.

Referring to FIGS. 6 and 18, the bag 12 is preferably initially completely sealed about the perimeter preventing comestible product flow from the nozzle 22. Referring to FIGS. 1, 17, 20 and 23, once the bag 12 is properly positioned in the cartridge 14,14' and the cartridge 14,14' is slidably inserted into the body 32 of the dispenser 10,10', it is preferred that the nozzle 22 extends from the lower surface of the upper portion 36 of the dispenser 10,10'.

Figure 7:
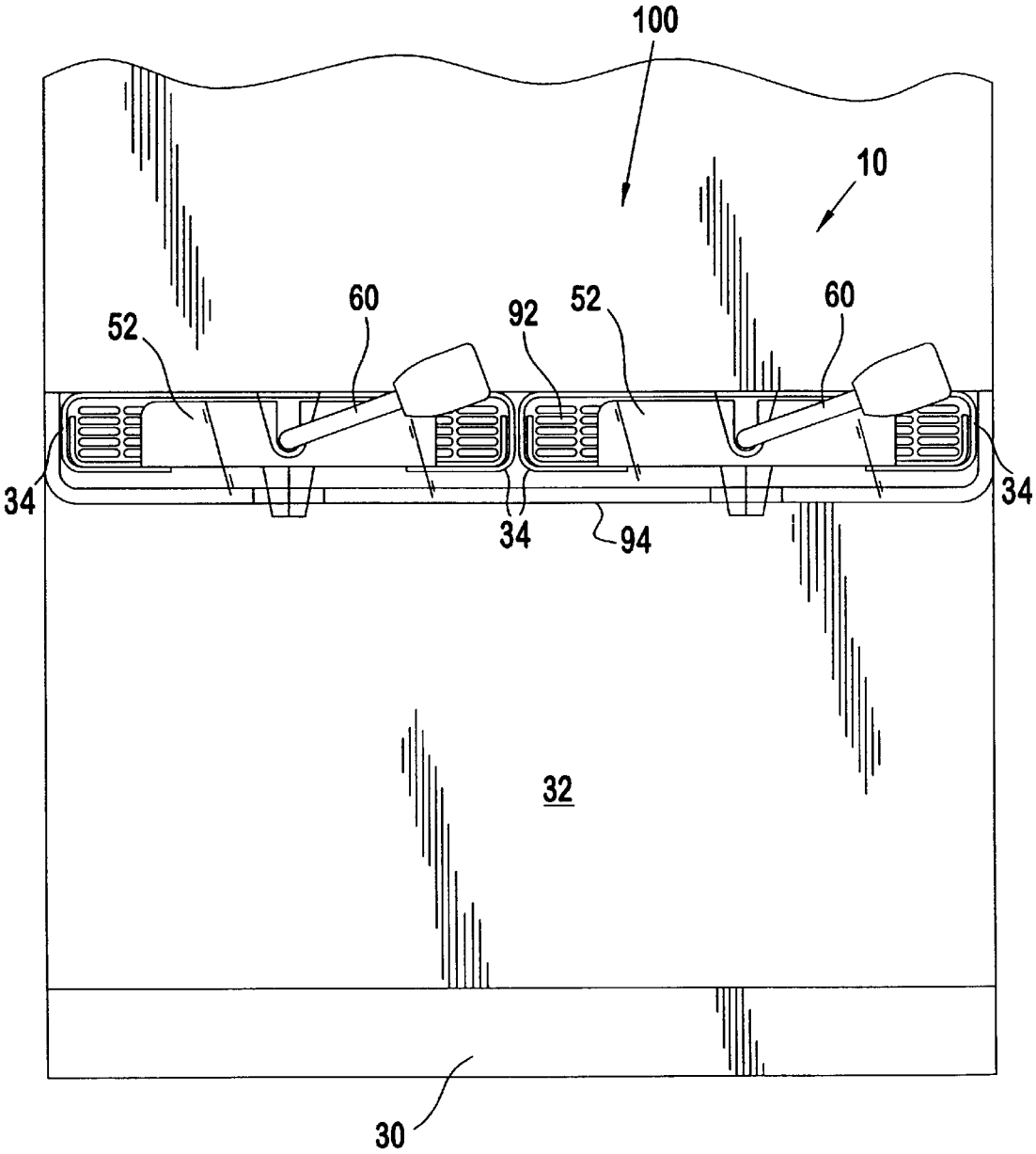
FIG. 7 is an enlarged partial front elevational view of the dispenser of FIG. 1.
Figure 16:
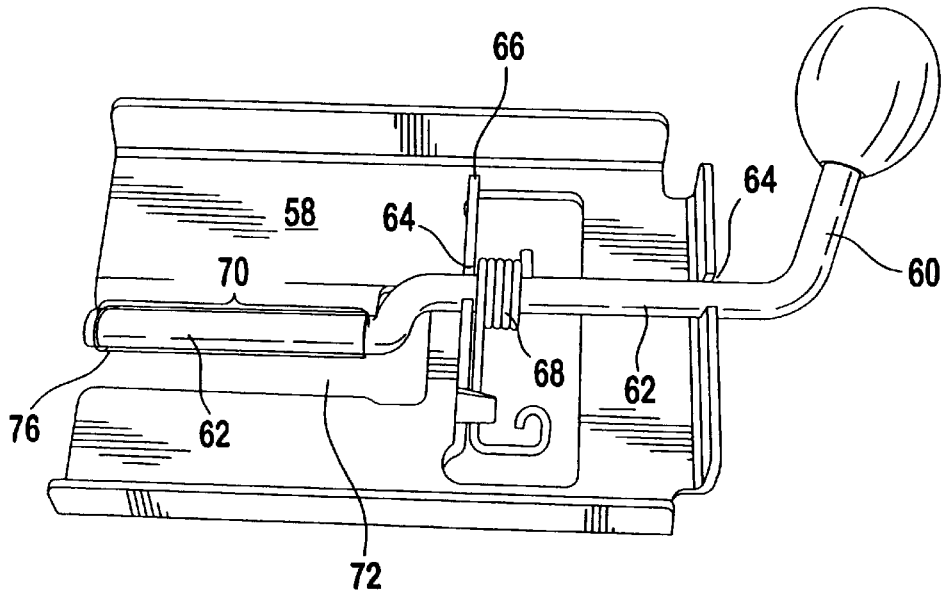
FIG. 16 is a top perspective view of a nozzle clamp assembly of the dispenser of FIG. 1.

Referring to FIGS. 7, 16 and 19, a nozzle clamp assembly 52 is preferably detachably engaged to the dispenser body 32 proximate to the opening. The nozzle clamp assembly 52 preferably includes a base 58 having a slot 72 configured to receive at least a portion of the bag nozzle 22 therein. The nozzle clamp assembly 52 is preferably attached to the dispenser body 32 via rails 34, which slidingly receive the nozzle clamp assembly 52, and is positioned around the bag nozzle 22 to control the flow of comestible product from the bag 12. The nozzle clamp assembly 52 is preferably moveable between a first position, proximate to the opening 18, and a second position, separated from the opening 18. The base 58 of the nozzle clamp assembly 52 is preferably formed from a single blank that is bent-up to the desired shape. It is preferred, but not necessary, that the base 58 have a generally rectangular shape.

A handled lever 60 extends from the base 58. The lever 60 is connected to an offset shaft 62 that is rotatably secured to the base 58. The shaft 62 preferably includes an offset, nozzle engaging portion 70 moveably disposed in the slot 72 that is biased against a side of the slot 72. The nozzle engaging portion 70 is preferably movable away from the side of the slot 72 to allow the bag nozzle 22 to be disposed between the nozzle engaging portion 70 of the shaft 62 and the side of the slot 72. Generally parallel walls 66 extend upward from the base 58 and each contain a groove 64 that receives the shaft 62. A torsion spring 68 preferably biases the shaft 62 into the closed position. The slot 72 extends through the nozzle clamp base 58 from an end of the base 58 opposite from the lever 60 generally toward the opposite end. It is preferred that the length of the slot 72 be greater than the length of the nozzle engaging portion 70 of the shaft 62. When the nozzle engaging portion 70 of the shaft 62 is biased into the closed position (shown in FIG. 16) the nozzle engaging portion 70 of the shaft 62 abuts the portion of the base 58 that forms one side of slot 72. By depressing the lever 60, the shaft 62 rotates causing the offset nozzle engaging portion 70 of the shaft 62 to move out of engagement with one side of the slot 72 in the base 58.

The nozzle clamp assembly 52 is supported underneath the upper portion 36 of the dispenser 10,10' by rails 34 that are located on the body 32 of the dispenser 10,10'. The rails 34 are preferably C-shaped with one rail 34 positioned over each side of the nozzle clamp assembly 52. During operation, the nozzle clamp assembly 52 is preferably inserted into the dispenser 10,10', as follows. First, a bag 12 is properly inserted into the cartridge 14,14' with the nozzle 22 protruding through the cartridge opening 18. Then, the cartridge 14,14' is positioned in the chamber 16 with the guide flanges 46 slidably inserted in the slots 50 provided by the channel members 48 (or with the alignment fin disposed in the rear bracket when using the second preferred embodiment of the cartridge). Once the cartridge 14 and the bag 12 are properly positioned within the dispenser 10,10' so that the nozzle 22 of the bag 12 extends downwardly from the upper portion 36 of the dispenser 10,10', the nozzle clamp assembly 52 is ready to slide over the bag nozzle 22. To engage the nozzle clamp assembly 52 with the nozzle 22, the end of the nozzle clamp assembly 52 opposite from the lever 60 is aligned with the grooves formed by the rails 34 and slid into the rail 34 grooves. Prior to fully inserting the nozzle clamp assembly 52 into the rails 34, the lever 60 is depressed causing the nozzle engaging portion 70 of the shaft 62 to be disengaged from a side of the base 58 forming the slot 72 to allow the nozzle 22 of the bag 12 to be inserted therebetween. Once the nozzle 22 is properly positioned between the nozzle engaging portion 70 of the shaft 62 and one side of the slot 72, the lever 60 is released and the torsion spring 68 returns the nozzle engaging portion 70 of the shaft 62 into the equilibrium position. When the nozzle engaging portion 70 of the shaft 62 is in the equilibrium position, the nozzle 22 of the bag 12 is sandwiched between the nozzle engaging portion 70 and one edge of the base 58 of the nozzle clamp assembly 52. This prevents any flow of the comestible product from the bag 12.

A loop of material (not shown) can be attached to one side of the bag nozzle 22 to allow the nozzle engaging portion 70 of the shaft 62 to be slid through the loop. Using a loop to attach the nozzle 22 to the nozzle engaging portion 70 simplifies the opening of the nozzle 22. Those of ordinary skill in the art will appreciate that various securing means can be used to connect sides of the nozzle 22 to the nozzle engaging portion 70 of the shaft 62 and to the base 58 of the nozzle clamp assembly 52. For example, adhesive or velcro connectors can be used without departing from the scope of the present invention. It is preferred, but not necessary, that a polymeric sheath 76 be positioned over the nozzle engaging portion 70 of the shaft 62 to facilitate clamping. The polymeric sheath 76 may be made of flexible tubing which can conform to the thicker portions around the heat sealed seams of the nozzle 22 during clamping. The sheath 76 may be made of a food grade PVC, urethane, silicone, or any other suitable material.

Figure 24:
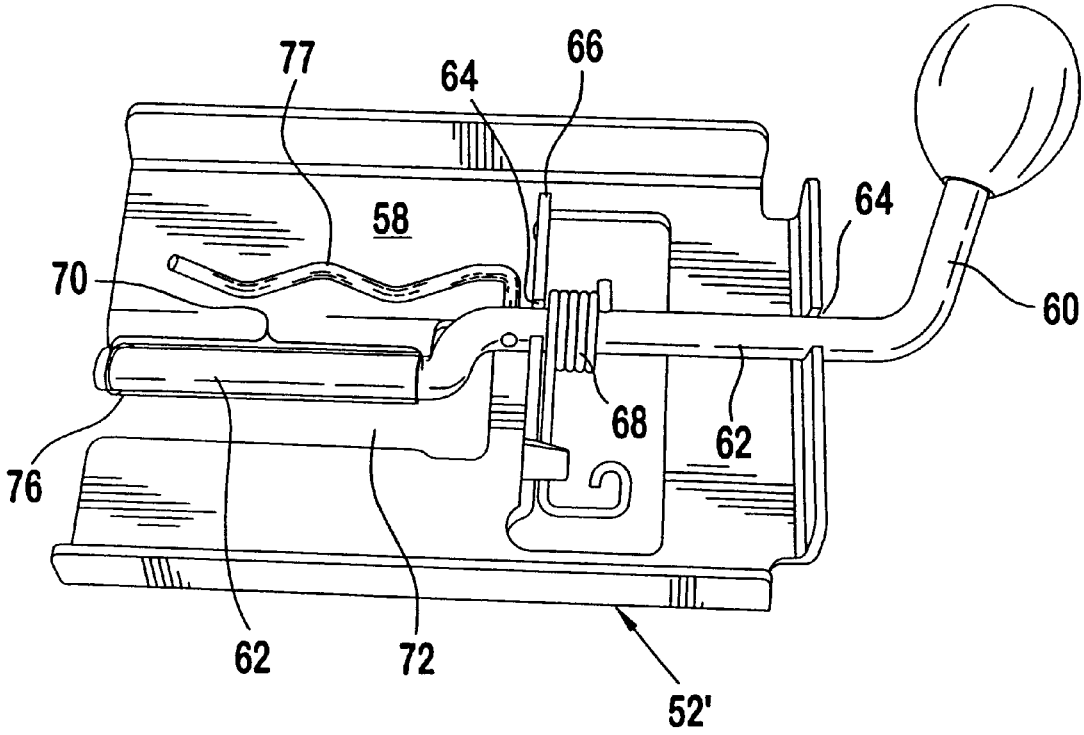
FIG. 24 is a top perspective view of a second embodiment of the nozzle clamp assembly.

Referring now to FIG. 24, an alternate embodiment of the nozzle clamp assembly 52' is shown. The nozzle clamp assembly 52' is the same as the nozzle clamp assembly 52, and further includes a push bar 77 connected to the shaft 62 of the lever 60. The push bar 77 is W-shaped, and is preferably formed of a bent metal rod that is press-fit or welded into an appropriately sized opening in the shaft 62. The push bar 77 is located above the base 58, and the nozzle 22 of the bag is preferably located between the push par 77 and the nozzle engaging portion 70 of the shaft 62 when the nozzle clamp assembly is inserted into the dispenser 10. The push bar 77 facilitates product flow when the lever 60 is pushed downwardly to open the nozzle clamp assembly 52, by helping the bag nozzle 22 to fully open. Due to the W-shaped configuration, the push bar 77 contacts the edges of the bag nozzle 22 as the nozzle clamp assembly 52 is opened, moving the nozzle away from the side of the slot 72 so that the nozzle 22 can flex open fully.

Referring again to FIG. 1, a heater 78 is preferably inserted into the narrow portion 34 of the dispenser 10 to heat and circulate air within the dispenser 10. The heater box 78 preferably has a generally rectangular shape and is complementarily sized for insertion into a cavity in the rear side of the dispenser 10. The heater box 78 has a side wall 82 with a bore 84 therethrough. A heating element 24 is positioned on the left side of the inner wall 82 with a circulating fan 26 disposed on a side of the heating element 24 opposite from the inner wall 82. Those of ordinary skill in the art will appreciate that the heating element 24 can be disposed on the right side of the side wall 82 and the circulating fan disposed on the left side of the side wall 82 without departing from the scope of the present invention.

Air is preferably circulated from the chamber 16, to the heater box 78, to the intermediate chamber 88, past the dispenser nozzle clamp assemblies 52, and returned to the chamber 16 of the dispenser 10,10'. As shown in FIG. 7, it is preferred that a nozzle cover 94, which include holes underneath the bag nozzles 22, surround the area around the nozzle clamp assembly 52 to keep the comestible product in the nozzle 22 in a heated condition. While it is preferred that a single nozzle cover 94 be used for multiple nozzle clamp assemblies 52, those of ordinary skill in the art will appreciate from this disclosure that individual nozzle covers 94 can be used for each nozzle clamp assembly without departing from the scope of the present invention.

Referring to FIGS. 1–23, the dispenser 10,10' of the present invention preferably operates as follows. A user removes the top (or top and front of the dispenser when using the second preferred embodiment of the dispenser 10') of the dispenser 10 and slidably removes at least one of the cartridges 14,14' from the chamber 16. Individual cartridges 14,14' are opened by separating the first and second cartridge shells 38A, 38B and placing bags 12 of comestible product therein. Once the bag 12 is positioned with the nozzle 22 aligned over the cartridge shell groove 40, the cartridges 14,14' are reassembled by aligning the guide flanges 46 (or the plugs 126 and holes 124) of the first and second shells 38A, 38B. Then the cartridges 14,14', along with the bags 12 contained therein, are slidably inserted into the chamber 16. Additional bags 12 may be placed on top of the bags 12 in the cartridge 14,14' for pre-heating.

Once the cartridges 14,14' with bags 12 are secured within the chamber 16, with the nozzles 22 of the bags 12 preferably extending from the lower side of the upper portion 36 of the dispenser 10, the nozzle clamp assemblies 52 can be inserted into the dispenser 10,10'. Each nozzle clamp assembly 52 is aligned with rails 34 that are disposed on the bottom of the upper portion 36 of the dispenser 10,10'. Prior to sliding the nozzle clamp assembly 52 into position, the lever 60 of the nozzle clamp assembly 52 is rotated clockwise causing the shaft 62 to rotate the nozzle engaging portion 70 out of contact with of the base 58. Then, the nozzle clamp assembly 52 is fully inserted into the dispenser 10,10' so that the nozzle 22 of the bag 12 is inserted between the nozzle engaging portion 70 and one side of the slot 72. Once the nozzle 22 of the respective bag 12 is properly positioned through the nozzle clamp assembly 52, the lever 60 is released which pinches the nozzle 22 to a closed position. Then, a user cuts the lower end of the nozzle 22 to allow the contents of the bag 12 to be dispensed. The temperature within the dispenser 10,10' is preferably monitored using a thermostat located on the side of the dispenser 10,10'. Once the comestible product reaches the appropriate temperature, a user can dispense comestible product by simply depressing the lever 60 in the clockwise direction.

It is recognized by those skilled in the art, that changes may be made to the above described embodiments of the invention without departing from the broad inventive concept thereof. For example, the cartridges 14,14' may be formed by a one piece unit or omitted all together; the two preferred embodiments of the cartridge 14, 14' can both be used in the same dispenser; and the front loading dispenser 10' can be modified to be a rear loading dispenser so that workers can fill the dispenser while concession operators dispense product for customers. Additionally, the protrusions 20 may have a triangular, rounded, polygonal shape, irregular shape or the like without departing from the scope of the present invention.

It is understood, therefore, that this invention is not limited to the particular embodiment disclosed, but that it is intended to cover all modifications which are within the spirit and scope of the invention as defined by the appended claims.

What is claimed is:

1. A system for dispensing a viscous comestible product, the system being capable of receiving a bag containing the viscous comestible product, the bag having a bag body and a hag nozzle, the system comprising:

a dispenser having a dispenser body defining a chamber for receiving the bag, the chamber having a surface with an opening defined therein adapted to receive the bag nozzle, the opening having a perimeter; and a first protrusion disposed proximate to the perimeter of the opening, the first protrusion extends from the surface generally inwardly into the chamber and being adapted to abut and flex the bag body into a configuration facilitating a flow of the viscous comestible product therefrom.

2. The system of claim 1, further comprising the bag containing the viscous comestible product wherein the first protrusion is configured to abut the bag, when the bag is located in the cartridge, to cause a portion of the bag to bow generally outwardly and extend over the first protrusion.

3. The system of claim 1, wherein the chamber receives at least two bags.

4. The system of claim 1, further comprising a nozzle clamp assembly detachably engaged to the dispenser body proximate to the opening, the nozzle clamp assembly comprising a base having a slot configured to receive at least a portion of the bag nozzle therein.

5. The system of claim 4, wherein the nozzle clamp assembly further comprises a shaft moveably disposed in the slot and biased against a side of the slot, the shaft being movable away from the side of the slot to allow the bag nozzle to be disposed between the shaft and the side of the slot.

6. The system of claim 5, wherein the dispenser body further includes rails which slidably receive the base of the nozzle clamp assembly so that the nozzle clamp assembly is moveable between a first position, proximate to the opening, and a second position, separated from the dispenser.

7. The system of claim 1, further comprising a second protrusion disposed on the surface of the chamber proximate to the perimeter of the opening on a side of the opening generally opposite from the first protrusion, that extends generally inwardly into the chamber.

8. The system of claim 7, wherein the first and second protrusions extend generally inwardly into the chamber from the surface and are adapted to abut generally opposing sides of the bag body.

9. The system of claims 7, wherein the opening is generally diamond shaped.

10. The system of claim 7, further comprising the bag containing the viscous comestible product, the bag being formed by two flexible sides connected together around a periphery of the two flexible sides, the periphery comprising a top edge, a bottom edge and two side edges, and the bottom edge integrally forming the bag nozzle with the bag body.

11. The system of claim 10, wherein the first and second protrusions abut the opposing flexible sides of the bag, each of the first and second protrusions forming first and second crease lines in the bag that each extend approximately from a separate lateral side of the integrally formed bag nozzle, proximate to where the bag nozzle extends from the bag body, upwardly at an angle toward an apex to form a generally V-shape.

12. The system of claim 7, wherein a distance between the first and second protrusions is between approximately one half (0.5) of an inch and approximately two (2) inches.

13. The system of claim 12, wherein the distance between the first and second protrusions is between approximately nine tenths (0.9) of an inch and approximately one and one half (1.5) inches.

14. The system of claim 1, further comprises the bag containing the viscous comestible product wherein the first protrusion is configured to abut the bag forming first and second crease lines in the bag body that each extend approximately from a separate side of the bag nozzle, proximate to where the bag nozzle intends from the bag body, toward an apex to form a generally V-shape.

15. The system of claim 14, wherein the first protrusion is configured to deform the bag such that a distance between where the bag nozzle extends from the bag body and the apex is between approximately one quarter (0.25) of an inch and approximately five (5) inches.

16. The system of claim 15, wherein the bag is free of fitments, attached tubes and other dispensing devices.

17. The system of claim 15, wherein the distance is between approximately one quarter (0.25) of an inch and approximately two (2) inches.

18. The system of claim 15, wherein the distance is between approximately one half (0.5) of en inch and one (1) inch.

19. The system of claim 1 wherein the chamber comprises a cartridge having an exterior surface and an interior and being removably disposed in the body, wherein a portion of the interior forms the surface with the first protrusion.

20. The system of claim 19, wherein the cartridge has at least one guide flange that is engageable with the dispenser body.

21. The system of claim 19, wherein the cartridge is formed by a first shell and a second shell.

22. The system of claim 21, wherein the first shell includes at least one plug capable of detachably engaging at least one hole in the second shell.

23. The system of claim 21, wherein the first and second shells each have a separate guide flange.

24. The system of claim 23, wherein the dispenser body comprises a channel member capable of slidingly receiving the guide flanges of the first and second shell.

25. A system for dispensing a viscous comestible product, the system being adapted to receive a bag containing the viscous comestible product, the bag having a bag nozzle, the system comprising:

a dispenser having a dispenser body defining a chamber and a passageway for fluid communication between the chamber an exterior portion of the dispenser; and a cartridge having an opening defined therein and being detachably engageable with the dispenser, the cartridge being adapted to substantially enclose the bag with at least a portion of the bag nozzle disposed in the opening the cartridge being configured so that the opening is aligned with the passageway when the cartridge is fully engaged with the dispenser, wherein the cartridge comprises:

a first shell having a first flange located along one side; and a second shell having a second flange located along one side, wherein when the first shell is aligned with the second shell to allow the cartridge to substantially enclose the bag therein, the first flange is aligned with the second flange.

26. The system of claim 25, wherein the dispenser body further includes a channel member engageable with both the first flange and the second flange.

27. A system for dispensing a viscous comestible product, the system being adapted to receive a bag containing the viscous comestible product, the bag having a bag nozzle, the system comprising:

a dispenser having a dispenser body defining a chamber and a passageway for fluid communication between the chamber and an exterior portion of the dispenser; and a cartridge having an opening defined therein and being detachably engageable with the dispenser, the cartridge adapted to substantially enclose the bar with at least a portion of the bag nozzle disposed in the opening the cartridge being configured so that the opening is aligned with the passageway when the cartridge is filly engaged with the dispenser, wherein the cartridge comprises:

a first shell having a pair of first flanges located along opposing sides; and a second shell having a pair of second flanges located along opposing sides, wherein when the first shell is aligned with the second shell to allow the cartridge to substantially enclose the bag therein, the pair of first flanges are aligned with the pair of second flanges.

28. The system of claim 27, wherein the dispenser body further includes a pair of channel members each engageable with both one of the pair of first flanges and one of the pair of second flanges.

29. A system for dispensing a viscous comestible product, the system being adapted to receive a bag containing the viscous comestible product, the bag having a bag nozzle, the system comprising:

a dispenser having a dispenser body defining a chamber and a passageway for fluid communication between the chamber and an exterior portion of the dispenser;

a cartridge having an opening defined therein and being detachably engageable with the dispenser, the cartridge being adapted to substantially enclose the bag with at least a portion of the bar nozzle disposed in the opening, the the cartridge is fully engaged with the dispenser; and the bag containing the viscous comestible product wherein the cartridge further comprises a protrusion disposed proximate to the opening and configured to about the bag, when the bag is located in the cartridge, to form first and second crease lines in the bag, each of the first and second crease lines extend approximately from a separate side of the bag nozzle, starting proximate to where the bag nozzle extends from the bag, at an angle to form an apes resulting in a portion of the bag being configured to include a V-shape.

30. The system of claim 29, wherein the first protrusion is configured to position the bag such that a distance between where the bag nozzle extends from the bag body and the apex is between approximately one quarter (0.25) of an inch and approximately five (5) inches.

31. The system of claim 29, wherein the first protrusion is configured to position the bag such that a distance between where the bag nozzle extends from the bag body and the apex is between approximately one half (0.5) of an inch and approximately one (1) inch.

32. A system for dispensing a viscous comestible product, the system being adapted to receive a bas containing the viscous comestible product, the bag having a bag nozzle, the system comprising:

a dispenser having a dispenser body defining a chamber and a passageway for fluid communication between the chamber and an exterior portion of the dispenser; and a cartridge having an opening defined therein and being detachably engageable with the dispenser being adapted to substantially enclose the bag with at least a portion of the bag nozzle disposed in the opening, the cartridge being configured so that the opening is aligned with the passageway when the cartridge is fully engaged with the dispenser, wherein the cartridge is configured to receive a second bag on top of the bag that is aligned with the opening to allow the second bag to preheat.

33. A system for dispensing a viscous comestible product, the system being adapted to receive a bag containing the viscous comestible product, the bag having a bag nozzle, the system comprising:

a dispenser having a dispenser body defined a chamber and a passageway for fluid communication between the chamber and an exterior portion of the dispenser; and a cartridge having an opening defined therein and being detachably engageable with the dispenser, the cartridge being adapted to substantially enclose the bag with at least a portion of the bag nozzle disclosed in the opening, the cartridge being configured so that the opening is aligned with the passageway when the cartridge is fully engaged with the dispenser wherein the cartridge comprises:

a first shell having at least one plug; and a second shell having at least one hole for receiving the at least one plug to detachably secure the first and second shells together.

* * * * *

UNITED STATES PATENT AND TRADEMARK OFFICE

CERTIFICATE OF CORRECTION

PATENT NO. : 6,726,061 B2
DATED : April 27, 2004
INVENTOR(S) : Richard L. Good

It is certified that error appears in the above-identified patent and that said Letters Patent is hereby corrected as shown below:

Title page,
Insert Item -- [73] Assignee: AFP Advanced Food Products, LLC, New Holland, PA --.
*Assistant Examiner*, delete "Buechlner" and insert therefor -- Buechner --.

Column 9,
Line 31, after the word "chamber", delete "an then," and insert therefor -- and then --.

Column 12,
Line 19, after the word "an", delete "offset", and insert therefor -- offset --.

Column 13,
Line 35, after the word "push", delete "par" and insert therefor -- bar --.

Column 14,
Line 31, after the word "with", delete "of".
Lines 57-58, delete the paragraph break between sentences.

Column 16,
Line 4, after the word "nozzle", delete "intends" and insert therefor -- extends --.
Line 35, after the word "second", delete "shell" and insert therefor -- shells --.
Line 46, after the second instance of the word "the", delete "opening" and insert therefor -- opening, --.

Column 17,
Line 2, after the word "cartridge", insert -- being --.
Line 4, after the second instance of the word "the", delete "opening" and insert therefor -- opening, --.
Line 6, after the word "is", delete "filly" and insert therefor -- fully --.
Line 31, after the first instance of the word "the", delete "bar" and insert therefor -- bag --.
Line 32, after the first instance of the word "the", insert -- cartridge being configured so that the opening is aligned with the passageway when --.
Line 37, delete "about" and insert therefor -- abut --.

UNITED STATES PATENT AND TRADEMARK OFFICE

CERTIFICATE OF CORRECTION

PATENT NO. : 6,726,061 B2
DATED : April 27, 2004
INVENTOR(S) : Richard L. Good

It is certified that error appears in the above-identified patent and that said Letters Patent is hereby corrected as shown below:

Column 18,
Line 9, after the word “a”, delete “bas” and insert therefor -- bag --.
Line 17, after the word “dispenser”, insert -- , cartridge --.
Line 39, after the word “the”, delete “dispenser” and insert therefor -- dispenser, --.

Signed and Sealed this

Twenty-fourth Day of August, 2004

JON W. DUDAS
*Director of the United States Patent and Trademark Office*